US007377302B2

(12) United States Patent
Nakamura et al.

(10) Patent No.: US 7,377,302 B2
(45) Date of Patent: May 27, 2008

(54) BLIND

(75) Inventors: Hidehiko Nakamura, Tokyo (JP); Koji Takagi, Tokyo (JP)

(73) Assignee: Nichibei Co. Ltd., Chuo-Ku, Tokyo (JP)

( * ) Notice: Subject to any disclaimer, the term of this patent is extended or adjusted under 35 U.S.C. 154(b) by 435 days.

(21) Appl. No.: 10/761,741

(22) Filed: Jan. 21, 2004

(65) Prior Publication Data

US 2004/0149400 A1 Aug. 5, 2004

(30) Foreign Application Priority Data

Jan. 24, 2003 (JP) ..... 2003-016542
Jun. 24, 2003 (JP) ..... 2003-180332
Jan. 13, 2004 (JP) ..... 2004-005887

(51) Int. Cl.
*E06B 9/36* (2006.01)

(52) U.S. Cl. ..... 160/168.1 V; 160/167 V

(58) Field of Classification Search ..... 160/168.1 V, 160/330, 344, 345, 167 V, 167 R, 341, 340, 160/900; 16/87.4 R
See application file for complete search history.

(56) References Cited

U.S. PATENT DOCUMENTS 962,361 A * 6/1910 Kuhl ..... 160/345
3,430,678 A * 3/1969 Barnes et al. ..... 160/346
4,240,489 A * 12/1980 Madsen ..... 160/126
4,293,021 A * 10/1981 Arena ..... 160/178.1 R
5,937,928 A * 8/1999 Chou ..... 160/168.1 V
6,533,017 B1 * 3/2003 Toti ..... 160/168.1 V
6,585,025 B2 * 7/2003 Welfonder ..... 160/168.1 V

FOREIGN PATENT DOCUMENTS

JP 2000-160965 6/2000
JP 2000-240377 9/2000
JP 2001-012172 1/2001

OTHER PUBLICATIONS

Office Action, Application No. 2004-005887, dated Oct. 3, 2008.

* cited by examiner

*Primary Examiner*—Blair M. Johnson
(74) *Attorney, Agent, or Firm*—Patterson & Sheridan, LLP

(57) ABSTRACT

A blind which allows the space underneath either desired end of its head rail to be opened by folding louvers beginning with the one at the desired end by a simple operation. A louver is hung from each one of a plurality of carriers that can move within a head rail and, among the carriers, the carrier arranged closest to the first end a of the head rail constitutes a first master carrier, and the carrier arranged closest to the second end of the head rail constitutes a second master carrier. By manipulating a first operating device, the first master carrier is moved toward the second end of the head rail to open the space underneath the first end, and by manipulating a second operating device, the second master carrier moved toward the first end of the head rail to open the space underneath the second end.

12 Claims, 21 Drawing Sheets

BLIND

CROSS-REFERENCE TO RELATED APPLICATIONS

This application claims benefit of Japanese patent application number 2003-16542, filed Jan. 24, 2003, Japanese patent application number 2003-180332, filed Jun. 24, 2003, and Japanese patent application number 2004-5887 filed Jan. 13, 2004 which are herein incorporated by reference.

BACKGROUND OF THE INVENTION

1. Field of the Invention

The present invention relates to a blind having louvers hung from each of a plurality of carriers that can run within a head rail, and more particularly to a blind permitting the space under either desired end of the opening of the head rail to be opened.

2. Description of the Related Art

A conventional blind of this kind has louvers hung from each of a plurality of carriers that can run within a head rail. When the operating device provided at an end of head rail is manipulated, the operating force of that operating device is transmitted to a master carrier to move the master carrier along the head rail, and the following carriers are similarly moved in the same direction as the master carrier to change the louvers between a folded state and an extended state into which they are pulled out.

When the window is to be opened, closed or cleaned, louvers in the extended state would obstruct the action, and they have to be folded. Even if the louvers are in the folded state, they may still obstruct the action near the end of the head rail where the louvers are gathered. As a solution to these problems, there is known a vertical blind whose the rear-end carrier is provided with a magnet or some other means so that the rear-end carrier is detachably held by the base end of the head rail (see Japanese Patent Application Laid-open No. 2000-160965). By using this holding means to disengage the rear-end louver from the base end of the head rail, the space under the base end of the head rail is opened at the time of opening, closing or cleaning the window to shift the louvers to a position where they would not obstruct the action.

However, in order to open the space under the base end of the head rail of the blind disclosed in the Japanese Patent Application cited above, the rear-end louver has to be grabbed directly by hand and disengaged from the base end of the head rail, and therefore the louver may be smeared or twisted. Moreover, if the head rail is rather high, it will be difficult to grab the louver at the rear end and move the carriers in the horizontal direction, resulting in poor workability and making it impossible disengage the louver smoothly from the base end of the head rail and moved out of the way.

An object of the present invention, attempted in view of the problems noted above, is to provide a blind whose louvers can be folded from one end onward to open the space under either end of the head rail.

BRIEF SUMMARY OF THE INVENTION

In order to achieve the object stated above, according to the first aspect of the present invention, a blind comprises a head rail, a plurality of carriers that can run within the head rail, a louver hung from each of the carriers, a first operating device and a second operating device. The louvers are moved to open a space under a first end of the head rail by manipulating the first operating device, and the louvers are moved to open a space under a second end of the head rail by manipulating the second operating device.

According to the invention, louvers can be moved to open the space under the first end of the head rail by manipulating the first operating device, and the louvers can be moved to open the space under the second end of the head rail second operating device, thereby enabling either desired end of the head rail to be opened to facilitate opening, closing or cleaning of the window, and enable persons to go out or come in, or ventilation to be done, through a gap beside the opened window. Since the louvers can be moved without holding any of them directly by hand, the louvers can be prevented from being smeared or twisted.

Among the carriers, the carrier arranged closest to the first end of the head rail can constitute a first master carrier and the carrier arranged closest to the second end of the head rail can constitute a second master carrier so that manipulation of the first operating device causes the first master carrier to move toward the second end of the head rail thereby to open the space underneath the first end and manipulation of the second operating device causes the second master carrier to move toward the first end of the head rail thereby to open the space underneath the second end.

Any appropriate means can be used for moving the master carriers, such as a cord type using cords, a screw rod type rotating a screw rod arranged in the head rail and screwed into the master carriers, or a baton type using an operating rod, such as a baton, to move the carriers.

Namely, within the head rail, an endless first cord connected to the first master carrier can be arranged around to move the first master carrier by manipulating the first operating device and an endless second cord connected to the second master carrier can be arranged around to move the second master carrier by manipulating the second operating device.

Alternatively, within the head rail, a first screw rod on which the first master carrier is threadably mounted is rotatably supported to move the first master carrier by manipulating the first operating device and a second screw rod on which the second master carrier is threadably mounted is rotatably supported to move the second master carrier by manipulating the second operating device.

Alternatively, within the head rail, an endless cord connected to the first master carrier can be arranged around to move the first master carrier by manipulating the first operating device and a screw rod screwed on which the second master carrier is threadably mounted is rotatably supported to move the second master carrier by manipulating the second operating device.

According to the second aspect of the present invention, a blind comprises a head rail, a plurality of carriers that can run within the head rail, a louver hung from each of the carries, a first operating device and a second operating device. The louvers are moved to open a space underneath both ends of the head rail by manipulating the first operating device and the louvers are moved to open a space underneath the central part of the head rail by manipulating the second operating device.

According to the invention, the louvers can be moved to open the space underneath both ends of the head rail by the first operating device and the louvers can be moved to open the space underneath the central part of the head rail by manipulating the second operating device. In this way, the space underneath either end or both ends of the head rail can be opened to facilitate opening, closing or cleaning of the window, and enable persons to go out or come in, or ventilation to be done, through a gap beside the opened window. Since the louvers can be moved without holding any of them directly by hand, the louvers can be prevented from being smeared or twisted.

Among the carriers, the carrier arranged closest to the first end of the head rail can constitute a first master carrier, the carrier arranged closest to the second end of the head rail can constitute a second master carrier, the carrier arranged on the first end's side of the central carriers can constitute a third master carrier and the carrier arranged on the second end's side of the central carriers can constitute a fourth master carrier so that manipulation of the first operating device causes the first master carrier to move toward the second end of the head rail and the second master carrier to move toward the first end of the head rail, thereby to open the space underneath both ends, and manipulation of the second operating device causes the third master carrier to move toward the first end of the head rail and the fourth master carrier to move toward the second end of the head rail, thereby to open the space underneath the central part of the head rail.

Any appropriate means can be used for moving the master carriers, such as a cord type using cords, a screw rod type rotating a screw rod arranged in the head rail and screwed into the master carriers, or a baton type using an operating rod, such as a baton, to move the carriers.

Namely, within the head rail, an endless first cord connected to the first master carrier and the second master carrier is arranged around to move the first master carrier and the second master carrier by manipulating the first operating device, and an endless second cord connected to the third master carrier and the fourth master carrier is arranged around to move the third master carrier and the fourth master carrier by manipulating the second operating device.

Alternatively, within the head rail, a first screw rod on which the first master carrier and the second master carrier are threadably mounted is rotatably supported to move them by manipulating the first operating device and a second screw rod on which the third master carrier and the fourth master carrier are threadably mounted is rotatably supported to move them by manipulating the second operating device.

Alternatively, within the head rail, an endless cord connected to the first master carrier and the second master carrier is arranged around to move them by manipulating the first operating device and a screw rod on which the third master carrier and the fourth master carrier are threadably mounted is rotatably supported to move them by manipulating the second operating device.

Alternatively, within the head rail, a screw rod on which the first master carrier and the second master carrier are threadably mounted is rotatably supported to move them by manipulating the first operating device and an endless cord connected to the third master carrier and the fourth master carrier is arranged around to move them by manipulating the second operating device.

Either one of the endless first cord and the endless second cord can be arranged on the front side of the head rail and the other is arranged on the rear of the head rail. In this way, it is possible to prevent the first cord and the second cord from becoming intertwined or coming into contact with each other within the head rail.

Alternatively, either one of the endless first cord and the endless second cord can be arranged inside of the other. In this way, it is possible to prevent the first cord and the second cord from becoming intertwined or coming into contact with each other within the head rail.

Alternatively, the endless first cord can be arranged on the first end's side of the head rail and the endless second cord can be arranged on the second end's side of the head rail.

Each of the carriers can be connected to the adjoining ones at a maximum spacing which is equal to a prescribed spacing, and two central carriers among the plurality of carriers can be connected to be separable from each other. In this way, it is also possible to open the space underneath the central part of the head rail by separating two central carriers and moving one of them toward the first end and the other toward the second end of the head rail.

One end of each of spacer links is fixed to each carrier except the carrier closest to the first end of the head rail, and the other end of each of the spacer links can be slidably connected to the adjoining carrier on the first end's side of the carrier for linking the carriers to the adjoining carriers at the maximum spacing which is equal to the prescribed spacing; and a stopper, which permits the passage of the carrier closest to the first end of the head rail and prohibit the passage of the next carrier, is provided in the vicinity of the first end of the head rail. As in this configuration, when the plurality of carriers move toward the first end of the head rail to cause the louvers to be folded, the stopper permits the passage of the carrier closest to the first end of the head rail and prohibits the passage of the next carrier, it is possible to prevent the spacer links from hitting against and breaking components near the first end of the head rail or the first end itself so as to keep the next carrier to which one end of the spacer link is fixed away from the first end of the head rail.

The first end of the head rail is provided with a third operating device and the second end is provided with a fourth operating device, wherein the louvers are turned by manipulating the third operating device or the fourth operating device. In this way, the louvers can be turned by manipulating the third operating device or the fourth operating device from either end of the head rail.

Needless to mention, unlike in the configuration described above, the first operating device may be positioned elsewhere than the first end or the second operating device, elsewhere than the second end of the head rail.

The present disclosure relates to subject manner contained in Japanese Patent Applications Nos. 2003-16542 filed on Jan. 24, 2003, and 2003-180332 filed on Jun. 24, 2003, which are expressly incorporated herein by references in their entirety.

DETAILED DESCRIPTION OF THE PREFERRED EMBODIMENTS

Figure 1:
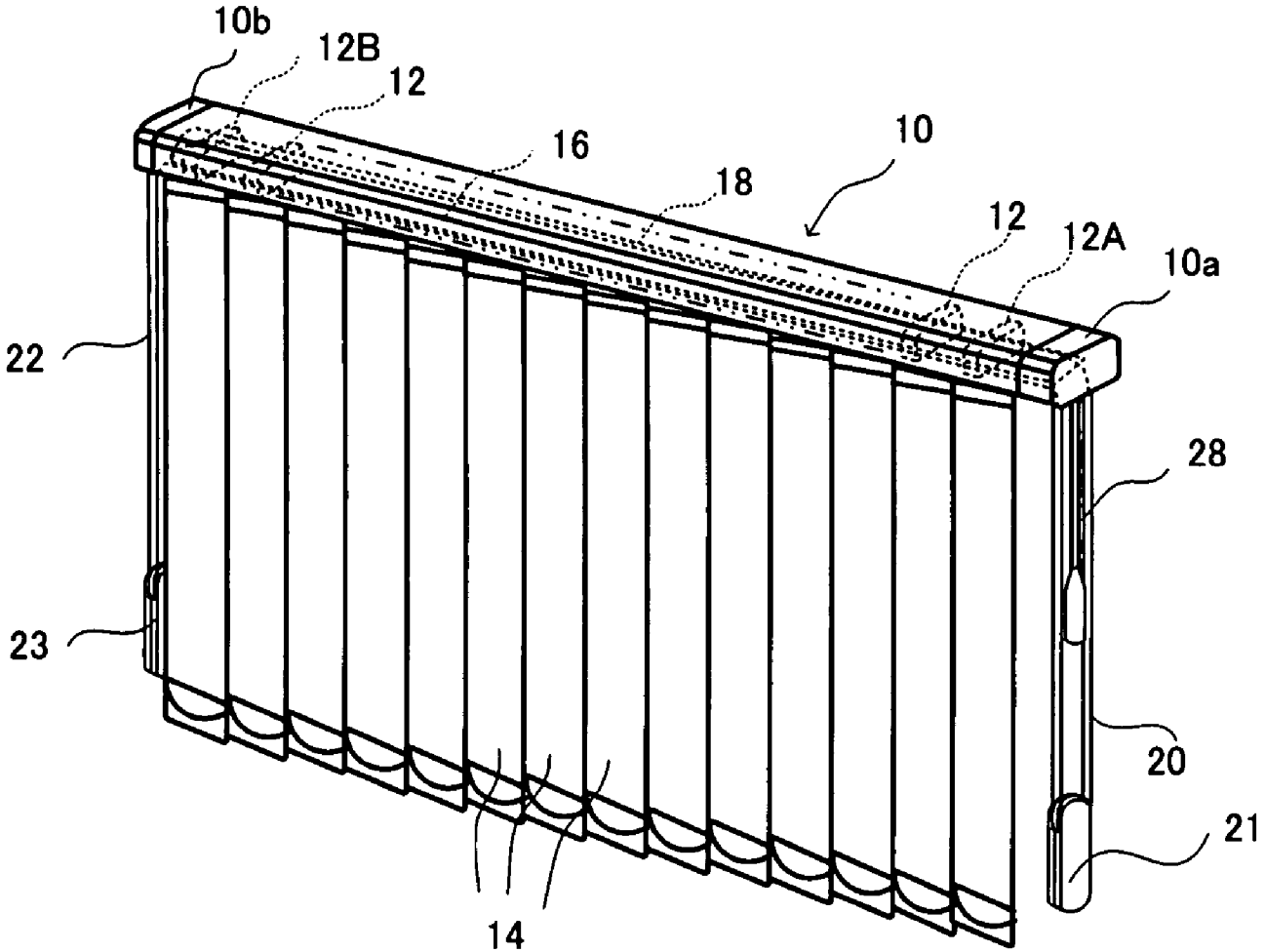
FIG. 1 shows a perspective view of a vertical blind according to a preferred embodiment of the present invention.
Figure 2:
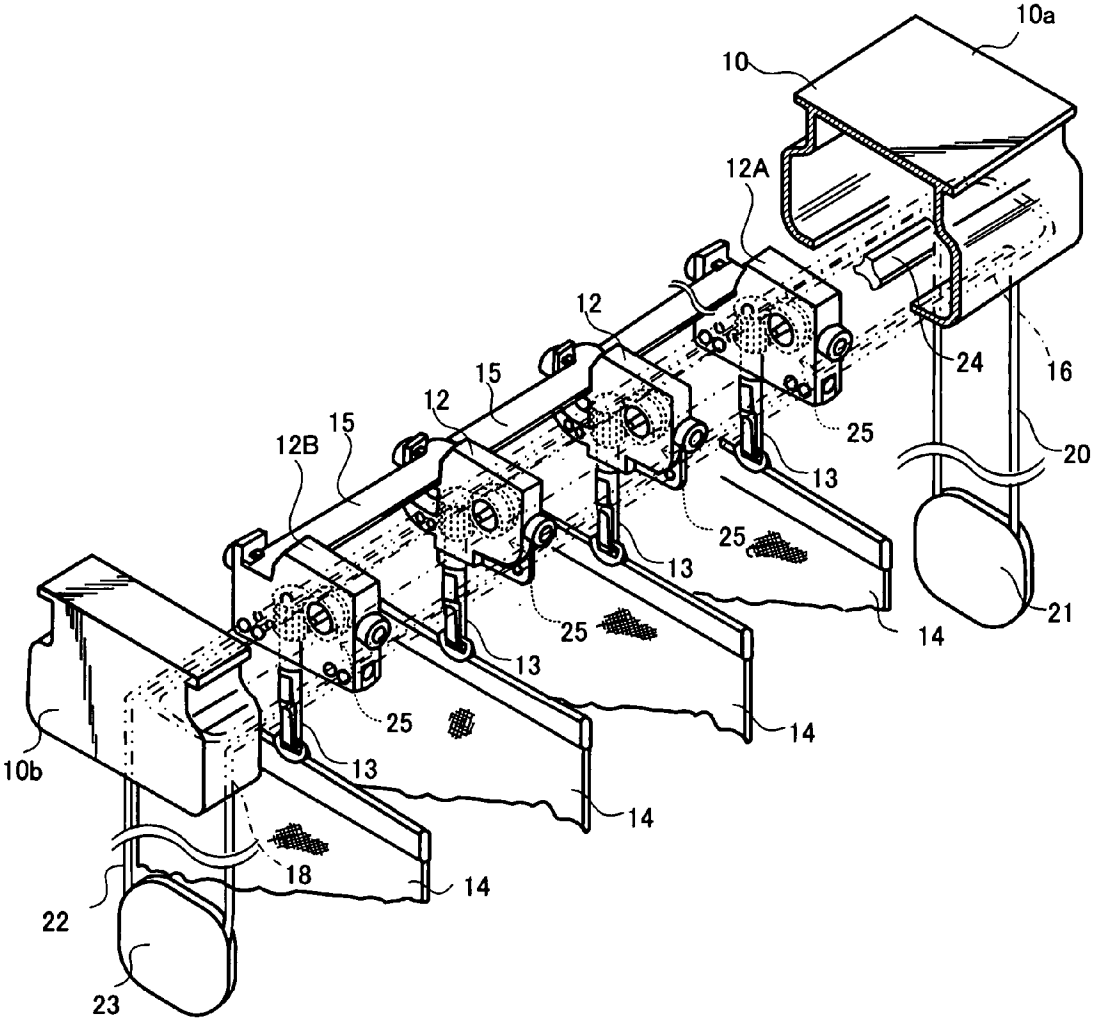
FIG. 2 shows a perspective view of the inside of the head rail of the vertical blind shown in FIG. 1.

Preferred embodiments of the present invention will be described below with reference to the accompanying drawings.

First Embodiment

As illustrated, the vertical blind has a head rail 10 which is fixed to the window frame, wall face or the like with brackets, and a plurality of carriers 12 are slidably arranged in the lengthwise direction in the head rail 10. A louver 14 is hung from each of the carriers 12 via a hook 13.

The closest one among the plurality of carriers 12 to a first end 10*a* of the head rail 10 constitutes a first master carrier 12A, and the closest one to a second end 10*b* of the head rail 10 constitutes a second master carrier 12B. An endless first cord 16 is connected to the first master carrier 12A, and an endless second cord 18 is connected to the second master carrier 12B.

The first cord 16, with one of its ends being connected to the first master carrier 12A, runs through other carriers 12 and through the second master carrier 12B except the first master carrier 12A within the head rail 10 toward the second end 10*b* of the head rail 10 and, after being turned around at the second end 10*b* of the head rail 10, runs through all the carriers 12 toward the first end 10*a* of the head rail 10. After being led out of the first end 10*a* of the head rail 10, the first cord 16 is turned around and directed toward the first master carrier 12A, and its other end is connected to the first master carrier 12A to make the cord endless. The part of the first cord 16 led out of the first end 10*a* of the head rail 10 and turned around constitutes a first operating device 20. The turnaround part of the first operating device 20 runs through a weight 21.

Similarly the second cord 18, with one of its ends being connected to the second master carrier 12B, runs through other carriers 12 and through the first master carrier 12A except the second master carrier 12B within the head rail 10 toward the first end 10*a* of the head rail 10 and, after being turned around at the first end 10*a* of the head rail 10, runs through all the carriers 12 toward the second end 10*b* of the head rail 10. After being led out of the second end 10*b* of the head rail 10, the second cord 18 is turned around and directed toward the second master carrier 12B and its other end is connected to the second master carrier 12B to make the cord endless. The part of the second cord 18 led out of the second end 10*b* of the head rail 10 and turned around constitutes a second operating device 22. The turnaround part of the second operating device 22 runs through a weight 23.

Within the head rail 10, the first cord 16 is arranged around inside the second cord 18, and this arrangement can prevent the first cord 16 and the second cord 18 from interfering with each other or becoming intertwined or coming into contact with each other within the head rail 10. It is also possible to arrange around the endless loops of the first cord 16 and the second cord 18 in parallel to each other within the head rail 10. For example, mutual interference can be prevented by arranging the endless loop of the first cord 16 on the front side of the head rail 10 and the endless loop of the second cord 18 on the rear side of the head rail 10.

The carriers 12 are connected, with either the first master carrier 12A or the second master carrier 12B as a leader, to adjoining carriers 12 by spacer links 15 at a maximum spacing which is equal to a prescribed spacing determined by a length of the spacer link 15 between them.

Every carrier 12 is engaged with a tilting rod 24 extending within the head rail 10 in the lengthwise direction. The tilting rod 24 is rotatably supported within the head rail 10, and connected at the first end 10*a* of the head rail 10 to an operating rod 28 (third operating device) via a gear, such as a bevel gear. The operating rod may as well be connected to the tilting rod 24 at the second end 10*b* of the head rail 10, or operating rods (third operating device and fourth operating device) may be provided at both the first end 10*a* and the second end 10*b* of the head rail 10, each of which can be connected to the tilting rod 24. Each of the carriers 12 has a built-in tilt transmitting mechanism 25 which is to engage with the tilting rod 24. The tilt transmitting mechanism 25 transmits the rotation of the tilting rod 24 to the hooks 13 of the carriers 12. When the operating rod 28 is operated to be rotated, the rotation is transmitted to the tilting rod 24 thereby to rotate the hook 13 of each of the carriers 12 via the tilt transmitting mechanism 25 of the carriers 12 to turn the louvers 14.

The operations of the vertical blind configured as stated above will now be described with reference to FIG. 3 through FIG. 9.

Figure 4:
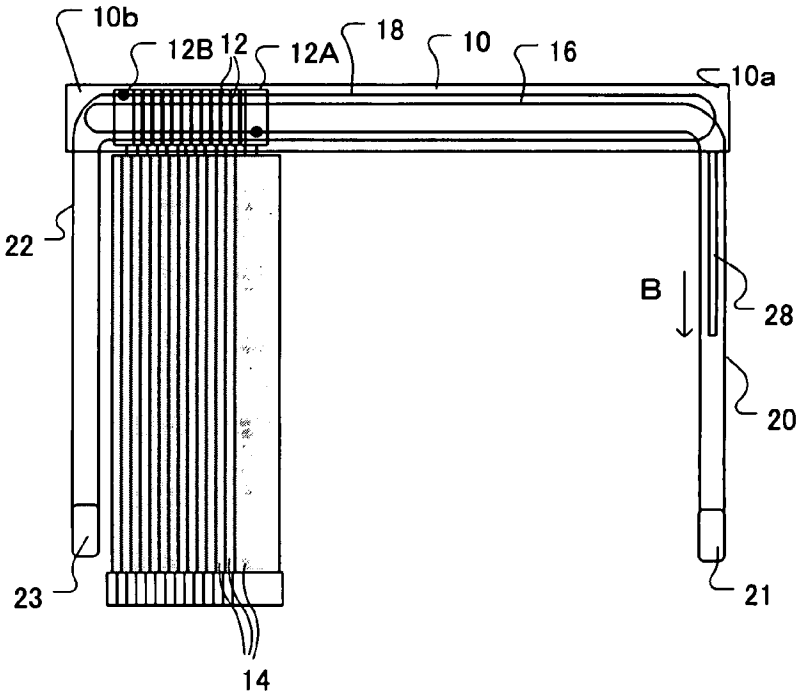
FIG. 4 illustrates the vertical blind according to the first embodiment in a state in which the louvers are folded at a second end of the head rail.
Figure 3:
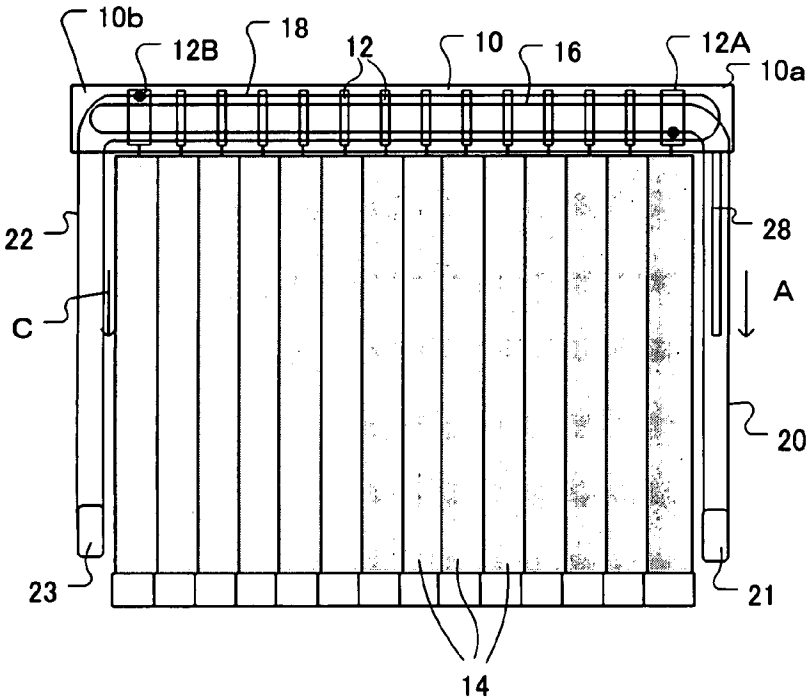
FIG. 3 illustrates the vertical blind according to a first embodiment of the invention (a plan view within the head rail and a front view below the head rail; the same applies hereinafter) in a state in which the louvers are extended over the whole length of the head rail.

When the first cord 16 is pulled in the direction of A in FIG. 3 by manipulating the first operating device 20 from the state in which the louvers 14 are extended all over the length of the head rail 10 as shown in FIG. 3, the first master carrier 12A moves toward the second end 10*b* of the head rail 10. When the first master carrier 12A moves, the other carriers 12 are pressed ahead successively in the same direction, and accordingly the louvers 14 move into a state of being folded at the second end 10*b* of the head rail 10 as shown in FIG. 4. The opening to which the vertical blind is installed can be thereby uncovered to enable the external view to be seen or the external atmosphere to be let in. From this state, when the operating device 20 is pulled in the direction of B, the first master carrier 12A moves toward the first end 10*a* of the head rail 10. Then, the spacer links 15 cause other adjoining carriers 12 to be successively pulled by the first master carrier 12A in the same direction to return to the state shown in FIG. 3.

Figure 5:
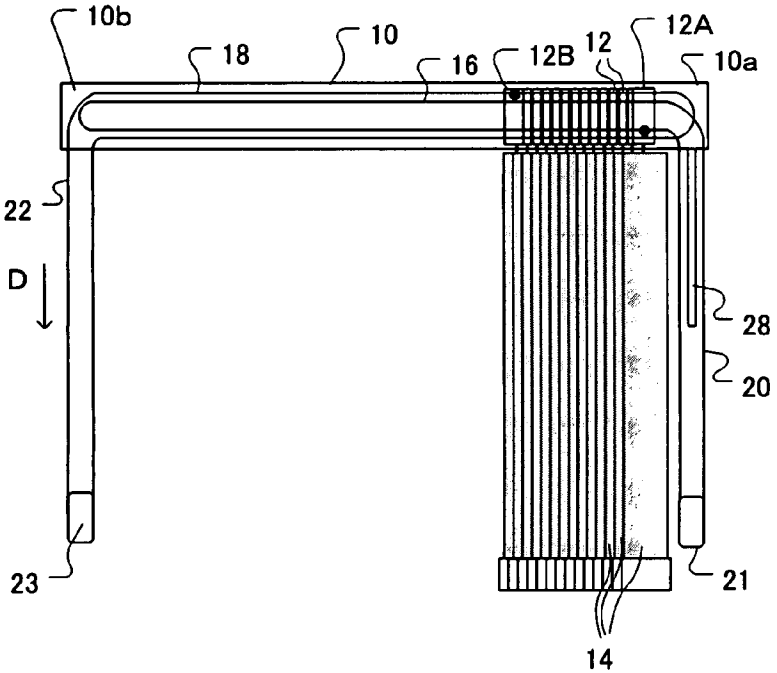
FIG. 5 illustrates the vertical blind according to the first embodiment in a state in which the louvers are folded at a first end of the head rail.

On the other hand, when the second cord 18 is pulled in the direction of C in FIG. 3 by manipulating the second operating device 22 from the state shown in FIG. 3, the second master carrier 12B moves toward the first end 10*a* of the head rail 10. Then, as the other carriers 12 are pressed ahead successively in the same direction, the louvers 14 move into a state of being folded at the first end 10*a* of the head rail 10 as shown in FIG. 5. Thus, as in the state shown in FIG. 4, the opening to which the vertical blind is installed can be thereby uncovered to enable the external view to be seen or the external atmosphere to be let in. When the operating device 22 is pulled in the direction of D, the second master carrier 12B moves toward the second end 10*b* of the head rail 10. Then, the spacer links 15 cause other adjoining carriers 12 to be successively pulled by the second master carrier 12B in the same direction to return to the state shown in FIG. 3.

Figure 6:
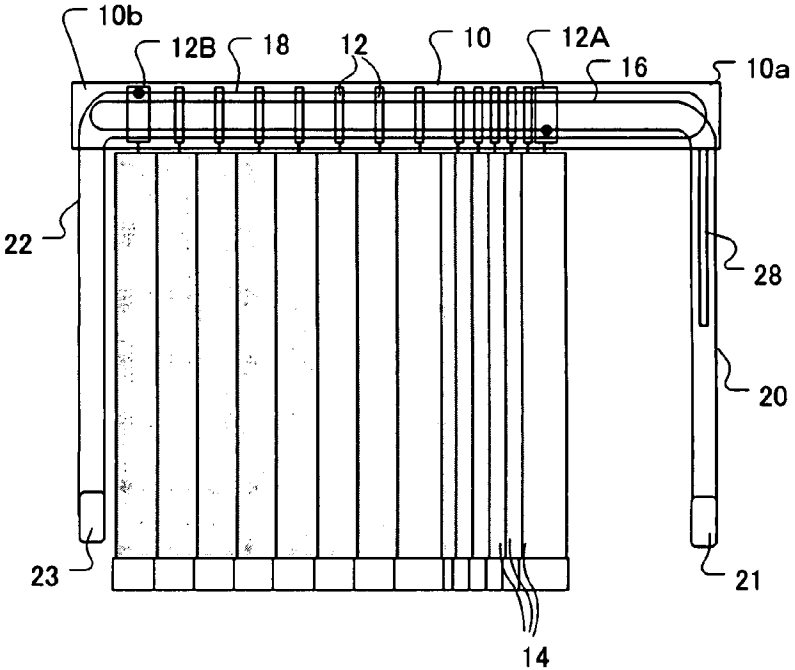
FIG. 6 illustrates the vertical blind according to the first embodiment in a state in which the first end of the head rail is opened.

If it is not necessary to fully open the blind but it is desired to open in the part at the first end 10*a* of the head rail 10, it is possible to pull the first operating device 20 in the direction A and stop the action when, for instance, the first master carrier 12A has come to the position shown in FIG. 6. Thus the space underneath the first end 10*a* of the head rail 10 is opened so that the part of the window at the first end 10*a* can be opened or closed, persons can go out or come in through that opening, the window can be cleaned, or ventilation can be achieved.

Figure 7:
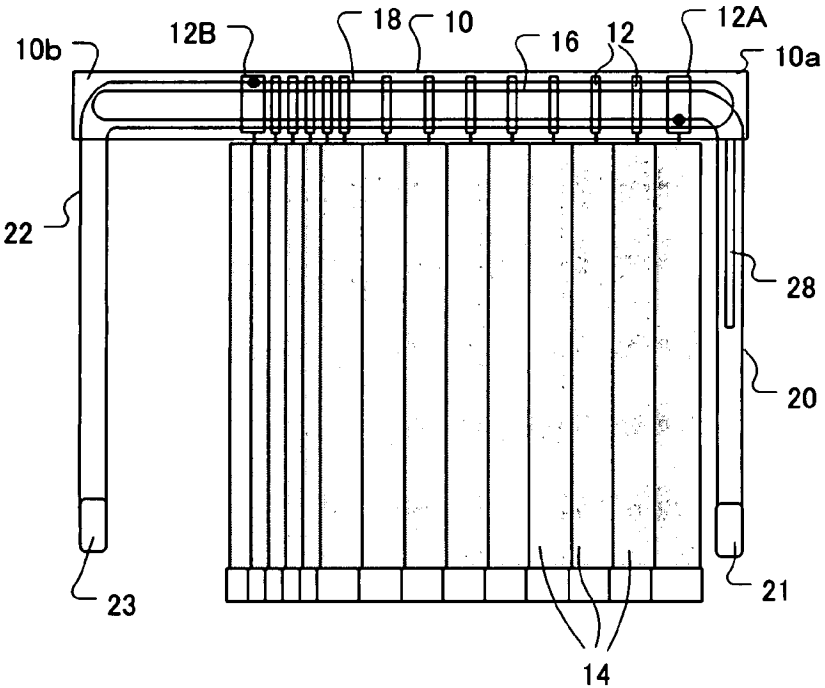
FIG. 7 illustrates the vertical blind according to the first embodiment in a state in which the second end of the head rail is opened.

If, conversely, it is desired to open the part of the blind at the second end 10*b* of the head rail 10, it is possible to pull the second operating device 22 in the direction of C, and stop the action when, for instance, the second master carrier 12B has come to the position shown in FIG. 7. Thus the space underneath the second end 10*b* of the head rail 10 is opened so that the part of the window at the second end 10*b* can be opened or closed, persons can be let go out or come in through that opening, the window can be cleaned, or ventilation can be achieved.

Figure 8:
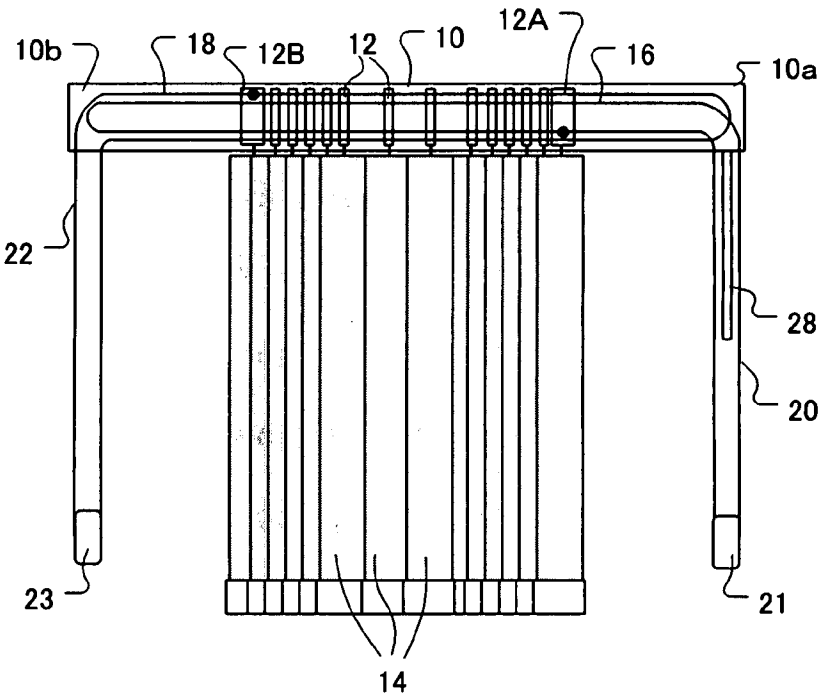
FIG. 8 illustrates the vertical blind according to the first embodiment in a state in which both ends of the head rail are opened.
Figure 10:
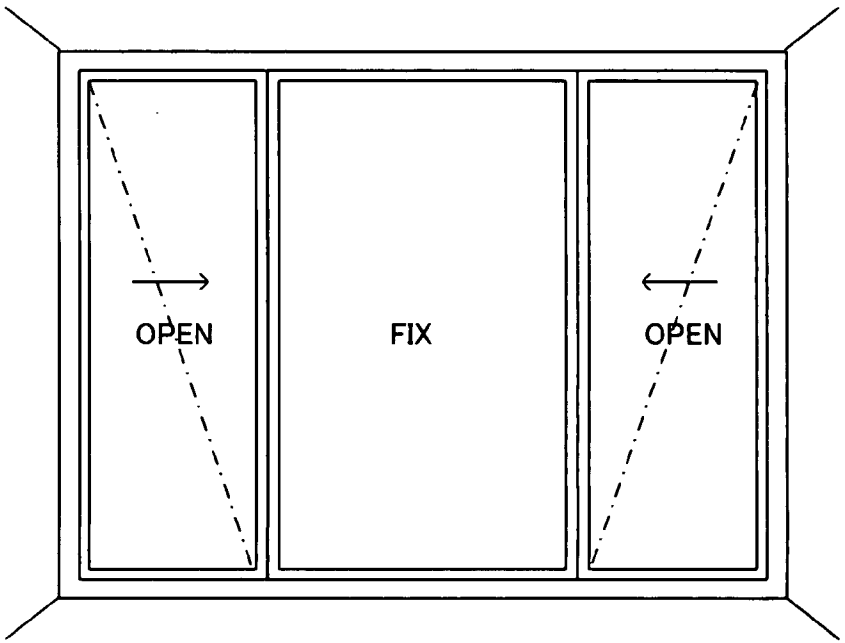
FIG. 10 shows an example of window to which the vertical blind according to the invention can be suitably applied.

Furthermore, when moving the first operating device 20 and the second the operating device 22 in the A and C directions, respectively, from the state shown in FIG. 3, the louvers 14 can be gathered in the center as shown in FIG. 8. In this way, the space underneath both the first end 10*a* and the second end 10*b* of the head rail 10 can be opened. In recently built condominiums, a wide terrace-facing window is an increasingly popular design. In the design, the central part of the window is fixed and the two side parts of the window can be opened, (see FIG. 10). To adapt the blind to such a window design to enable persons to go out or come in or to allow ventilation through those opened parts on the two sides, the two sides of the vertical blind can be made openable as shown in FIG. 8.

Figure 9:
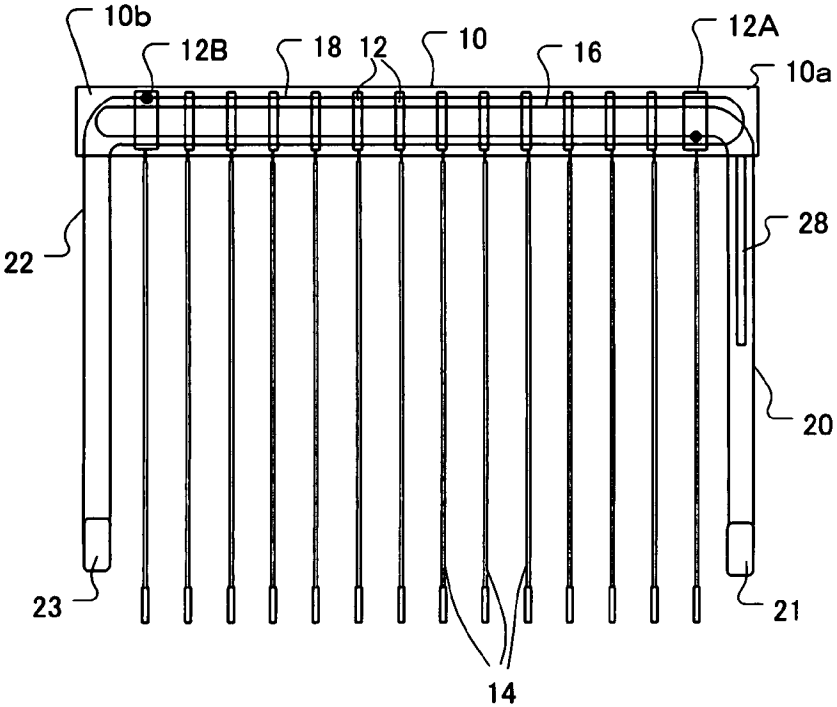
FIG. 9 illustrates the vertical blind according to the first embodiment in a state in which the louvers are turned.

Thus, it is possible to open the space underneath either end of the head rail 10 by manipulating the operating device 20 or 22. Furthermore, as the first operating device 20 and the second the operating device 22 are positioned at the first end 10*a* and the second end 10*b*, respectively, and the louvers 14 can be folded at either end by manipulating the operating device toward the one or the other of the ends 10*a* and 10*b*, the operator can conveniently manipulate the blind from either side close to him or her. Also, by rotating the operating rod 28, the louvers 14 can be turned as shown in FIG. 9 like those of a conventional vertical blind.

Furthermore, as the first operating device 20 is on the first end 10*a* side and the second the operating device 22 is on the second end 10*b* side, and the end closer to the operator casn be conveniently opened by manipulating at either end 10*a* or 10*b*, the side on which the manipulator desires to go out. It has to be noted, though, that in this embodiment of the invention, of course the configuration may as well be such that the first cord 16 to which the first master carrier 12A is connected be led out from the second end 10*b*, instead of the first end 10*a*, of the head rail 10 to constitute the first operating device and the second cord 18 to which the second master carrier 12B is connected be led out from the first end 10*a*, instead of the second end 10*b*, of the head rail 10 to constitute the second operating device.

Second Embodiment

Figure 11:
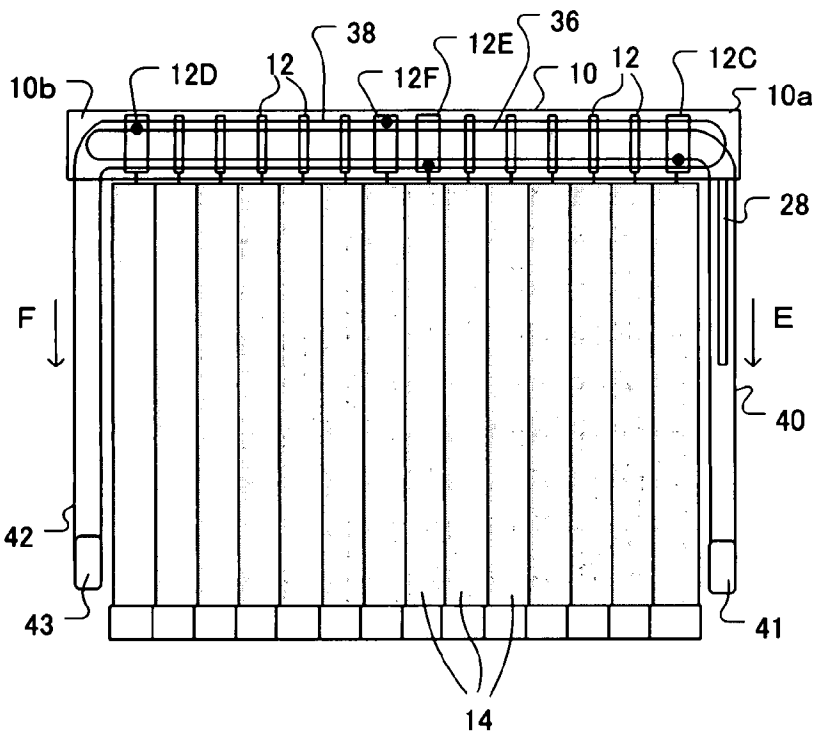
FIG. 11 illustrates a vertical blind according to a second embodiment of the invention, in a state in which the louvers are extended over the whole length of the head rail.

Next, FIG. 11 illustrates a vertical blind according to a second embodiment of the present invention, wherein the same constituent members as in the first embodiment are denoted by respectively the same reference signs, and their detailed description will be omitted.

In this second embodiment, the closest one among the plurality of carriers 12 to the first end 10*a* of the head rail 10 constitutes a first master carrier 12C, and the one closest to the second end 10*b* of the head rail 10 constitutes a second master carrier 12D. Further, out of the two central ones among the plurality of carriers 12, the carrier 12 on the side of the first end 10*a* constitutes a third master carrier 12E, and the carrier on the side of the second end 10*b* constitutes a fourth master carrier 12F. An endless first cord 36 is connected to the first master carrier 12C and the second master carrier 12D, and an endless second cord 38 is connected to the third master carrier 12E and the fourth master carrier 12F.

The first cord 36, with one of its ends being connected to the first master carrier 12C, runs through other carriers 12 except the first master carrier 12C within the head rail 10 toward the second end 10*b* of the head rail 10 and, after being turned around at the second end 10*b* of the head rail 10, is connected to the second master carrier 12D. Then it runs through other carriers 12 except the second master carrier 12D within the head rail 10 toward the first end 10*a* of the head rail 10 and, after being led out of the first end 10*a* of the head rail 10, is turned out and directed toward the first master carrier 12C. Its other end is connected to the first master carrier 12C to make the cord endless. The part of the first cord 36 led out of the first end 10*a* of the head rail 10 and turned around constitutes a first operating device 40. The turnaround part of the first operating device 40 runs through a weight 41.

The other second cord 38, with one of its ends being connected to the third master carrier 12E, runs through other carriers 12, on the side of the first end 10*a*, from the third master carrier 12E within the head rail 10 toward the first end 10*a* of the head rail 10 and, after being turned around at the first end 10*a* of the head rail 10, again runs through the carriers 12 to be connected to the fourth master carrier 12F. It runs through other carriers 12 on the side of the second end 10*b* from the fourth master carrier 12F within the head rail 10 toward the second end 10*b* of the head rail 10 and, after being let out of the second end 10*b* of the head rail 10, turned around, again runs through the carriers 12 toward the third master carrier 12E, with its other end being to the third master carrier 12E to make the cord endless. The part of the second cord 38 led out of the second end 10*b* of the head rail 10 and turned around constitutes a second operating device 42. The turnaround part of the second operating device 42 runs through a weight 43.

Within the head rail 10, the first cord 36 is arranged around inside the second cord 38, and this arrangement can prevent the first cord 36 and the second cord 38 from interfering with each other or becoming intertwined or coming into contact with each other within the head rail 10. It is also possible to arrange around the endless loops of the first cord 36 and the second cord 38 in parallel to each other within the head rail 10. For example, mutual interference can be prevented by arranging the endless loop of either the first cord 36 or the second cord 38 on the front side of the head rail 10 and the endless loop of the other cord on the rear side of the head rail 10.

Figure 12:
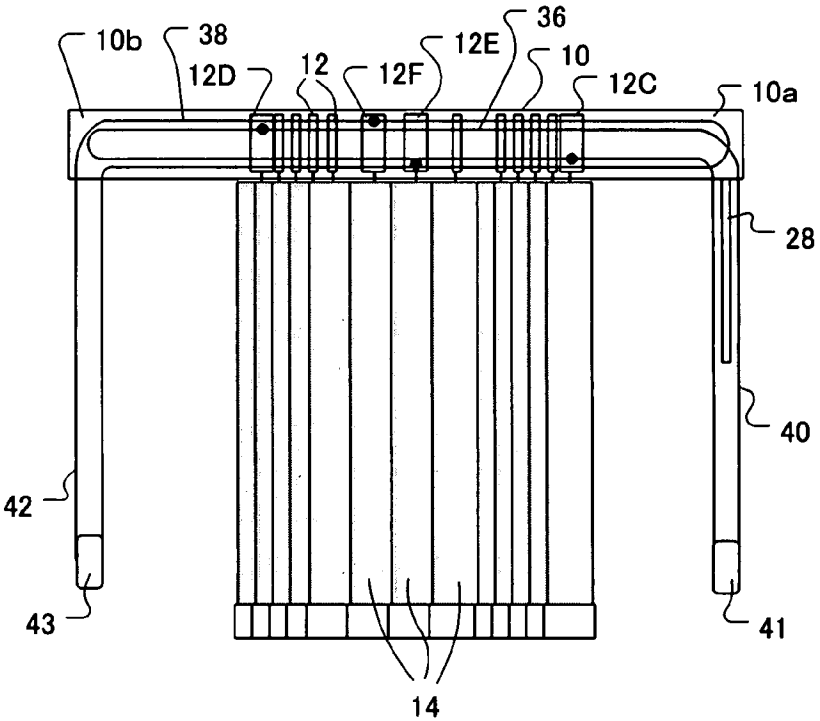
FIG. 12 illustrates the vertical blind according to the second embodiment in a state in which both ends of the head rail are opened.

The operations of the vertical blind configured as stated above will now be described with reference to FIG. 11 through FIG. 13.

When the first cord 36 is pulled in the direction of E in FIG. 11 by manipulating the first operating device 40 from the state in which the louvers 14 are extended all over the length of the head rail 10 as shown in FIG. 11, the first master carrier 12C moves toward the second end 10*b* of the head rail 10. At the same time, the second master carrier 12D moves toward the first end 10*a* of the head rail 10 to cause the adjoining carriers 12 to be successively moved in the same direction, thus all the carriers 12 are gathered to the center as shown in FIG. 12.

Thus, it is possible to open the space underneath both of the ends 10*a* and 10*b* of the head rail 10 with the result that the parts of the window at the ends 10*a* and 10*b* can be opened or closed, persons can go out or come in through that opening, the window can be cleaned, or ventilation can be achieved. Also, it can be adapted to the recently favored design of terrace-facing windows in condominiums.

Furthermore, when the second cord 38 is pulled in the direction of F in FIG. 11 by manipulating the second operating device 42, the third master carrier 12E moves toward the first end 10*a* of the head rail 10, and causes other carriers 12 closer to the first end 10*a* of the head rail 10 than the third master carrier 12E to move in the same direction. At the same time, the fourth master carrier 12F moves toward the second end 10*b* of the head rail 10, and causes other carriers 12 closer to the second end 10*b* of the head rail 10 than the fourth master carrier 12F to move in the same direction.

Figure 13:
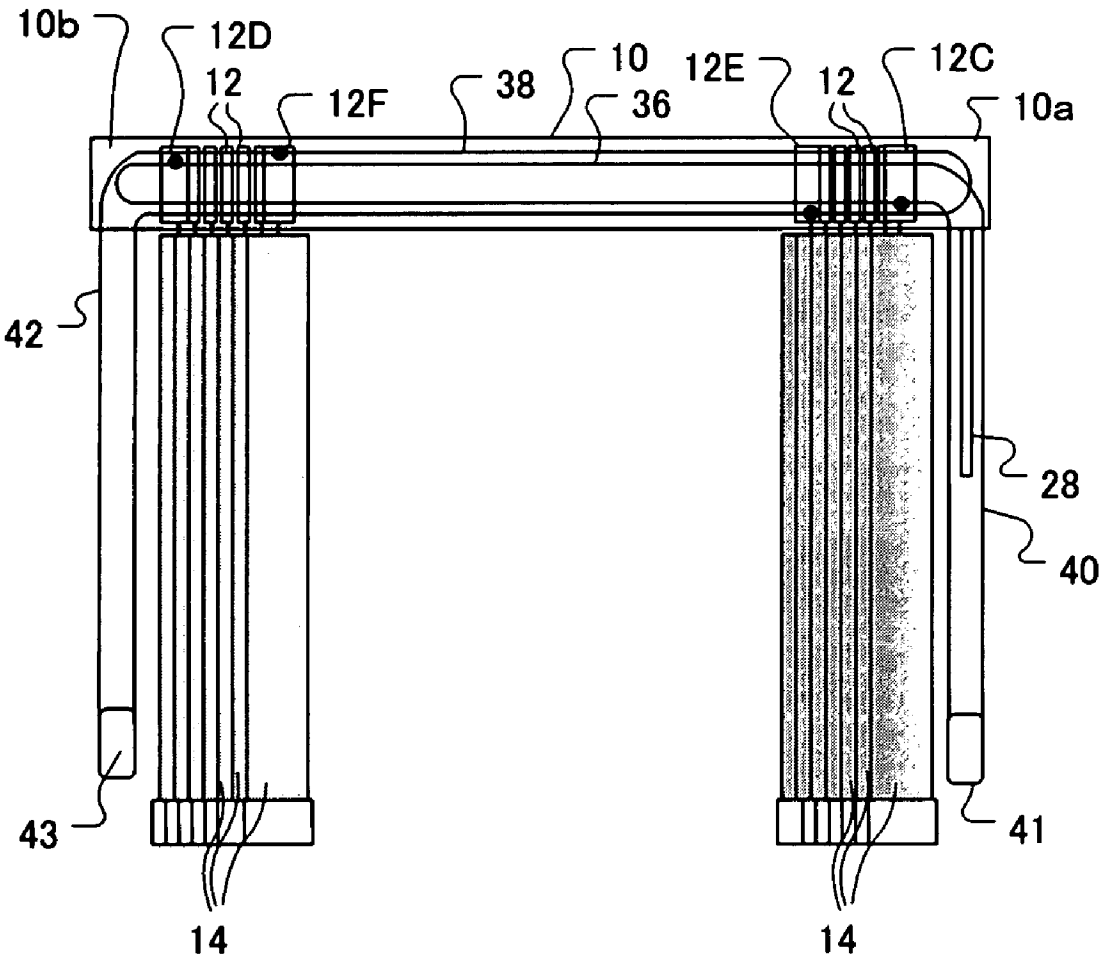
FIG. 13 illustrates the vertical blind according to the second embodiment in a state in which the central part of the head rail is opened.

Thus, as shown in FIG. 13, the louvers 14 can be separated to the two sides when they are folded, so that the central part of the opening which the vertical blind is installed can be uncovered to enable the external view to be seen or the external atmosphere to be let in.

Furthermore, as in the first embodiment of the invention, when the operating rod 28 is manipulated for rotating, the rotation is transmitted to the tilting rod 24 to rotate the hook 13 of each of the carriers 12 via the tilt transmitting mechanism 25 of the carriers 12, and the louvers 14 can be thereby rotated. In addition, as in the first embodiment, the operating rod 28 can be provided either for one of the first end 10*a* and the second end 10*b* or for each of them.

Third Embodiment

Figure 14:
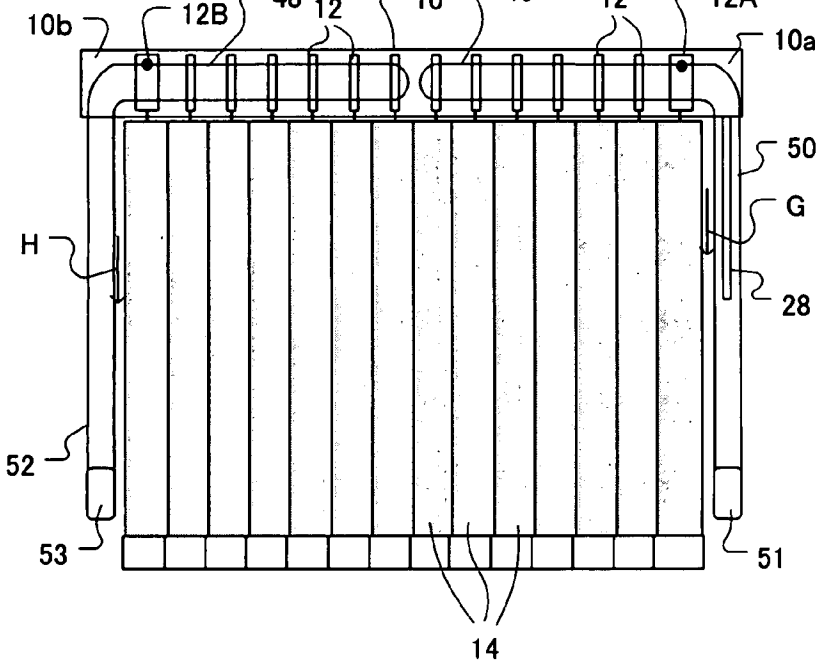
FIG. 14 illustrates a vertical blind according to a third embodiment of the invention, in a state in which the louvers are extended over the whole length of the head rail.

FIG. 14 illustrates a vertical blind according to a third embodiment of the present invention, wherein the same constituent members as in the foregoing embodiments are denoted by respectively the same reference signs, and their detailed description will be omitted.

In this third embodiment, the carrier closest to the first end 10*a* of the head rail 10 among the plurality of carriers 12 constitutes the first master carrier 12A, and the carrier closest to the second end 10*b* of the head rail 10 constitutes the second master carrier 12B. An endless first cord 46 is connected to the first master carrier 12A, and an endless second cord 48 is connected to the second master carrier 12B.

The first cord 46, with one of its ends being connected to the first master carrier 12A, runs through a half of other carriers 12 on the side of the first end 10*a* except the first master carrier 12A, within the head rail 10 toward the second end 10*b* of the head rail 10, and after being turned around in the central part of the head rail 10, runs through that the half of carriers 12 on the side of the first end 10*a*, toward the first end 10*a* of the head rail 10. After being let out of the first end 10*a* of the head rail 10, it is turned around to be directed to the first master carrier 12A, and its other end is connected to the first master carrier 12A to make the cord endless. The part of the first cord 46 led out of the first end 10*a* of the head rail 10 and turned around constitutes a first operating device 50. The turnaround part of the first operating device 50 runs through a weight 51.

Similarly the second cord 48, with one of its ends being connected to the second master carrier 12B, runs through a half of other carriers 12 on the side of the second end 10*b* except the second master carrier 12B, within the head rail 10 toward the first end 10*a* of the head rail 10 and, after being turned around in the central part of the head rail 10, runs through that the half of the second end 10*b* on the side of the second end 10*b* toward the second end 10*b* of the head rail 10. After being let out of the second end 10*b* of the head rail 10, it is turned around to be directed to the second master carrier 12B, and its other end is connected to the second master carrier 12B to make the cord endless. The part of the second cord 48 let out of the second end 10*b* of the head rail 10 and turned around constitutes a second operating device 52. The turnaround part of the second operating device 52 runs through a weight 53.

The operations of the vertical blind configured as stated above will now be described with reference to FIG. 14 through FIG. 18.

Figure 15:
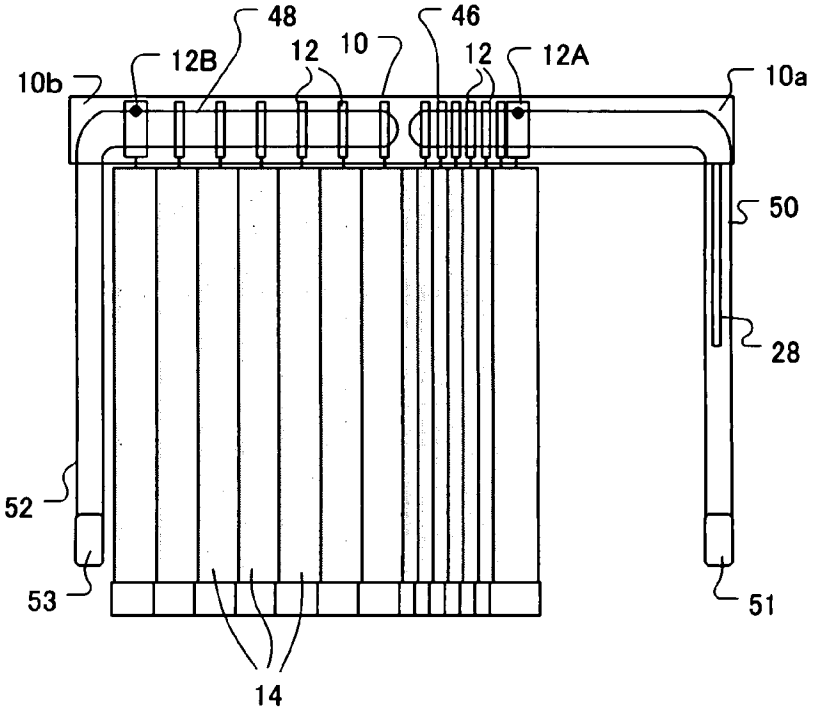
FIG. 15 illustrates the vertical blind according to the third embodiment in a state in which a first end of the head rail is opened.

When the first cord 46 is pulled in the direction of G in FIG. 14 by manipulating the first operating device 50 from the state in which the louvers 14 are extended all over the length of the head rail 10 as shown in FIG. 14, the first master carrier 12A moves toward the second end 10*b* of the head rail 10. When the first master carrier 12A moves, as it causes the other half of the carriers 12 on the side of the first end 10*a* to be successively moved in the same direction, the louvers 14 go into a state in which they are folded to the central part of the head rail 10 as shown in FIG. 15. Thus the space underneath the first end 10*a* of the head rail 10 is opened, and the part of the window at the first end 10*a* can be opened or closed, persons can go out or come in through that opening, the window can be cleaned, or ventilation can be achieved.

Figure 16:
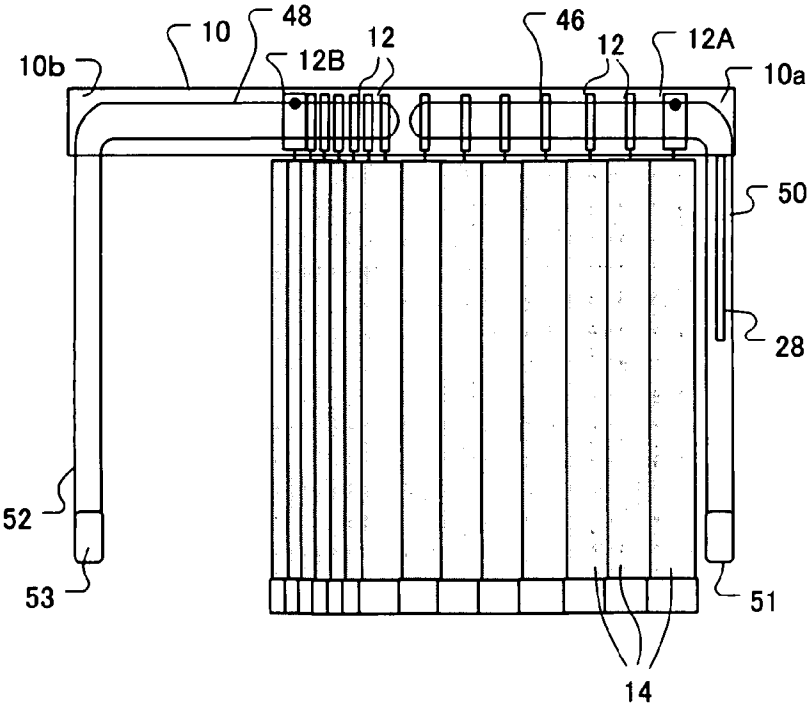
FIG. 16 illustrates the vertical blind according to the third embodiment in a state in which a second end of the head rail is opened.

If, conversely, it is desired to open the part of the blind at the second end 10*b* of the head rail 10, when the second cord 48 is pulled by manipulating the second operating device 52 in the direction of H from the state shown in FIG. 14, the second master carrier 12B moves toward the first end 10*a* of the head rail 10. When the second master carrier 12B moves, as it causes the other half of the carriers 12 on the side of the second end 10*b* to successively move in the same direction, the louvers 14 go into a state in which they are folded to the central part of the head rail 10 as shown in FIG. 16. Thus the space underneath the second end 10*b* of the head rail 10 is opened, and the part of the window at the second end 10*b* can be opened or closed, persons can be let go out or come in through that opening, the window can be cleaned, or ventilation can be achieved.

Figure 17:
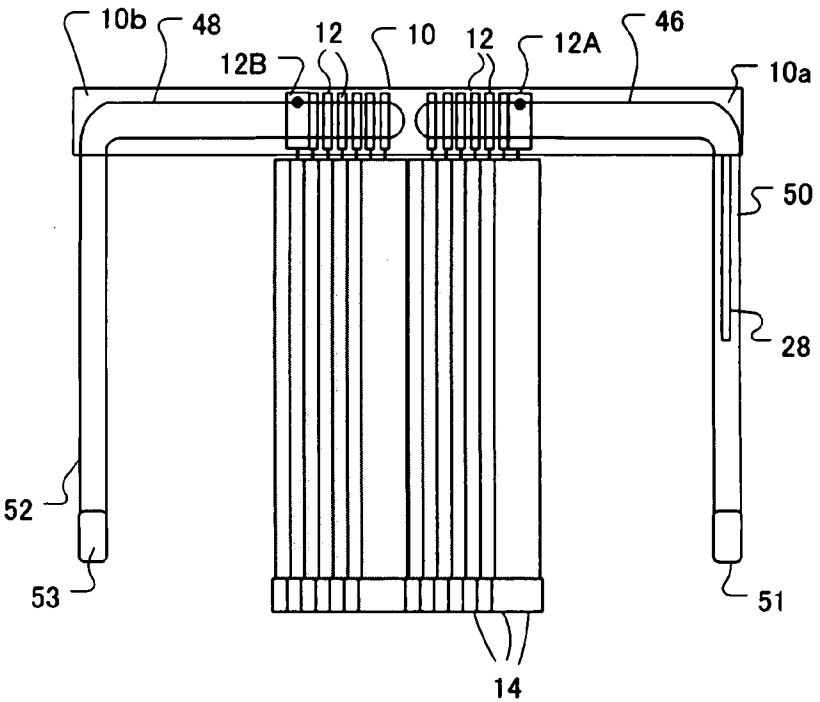
FIG. 17 illustrates the vertical blind according to the third embodiment in a state in which both ends of the head rail are opened.
Figure 18:
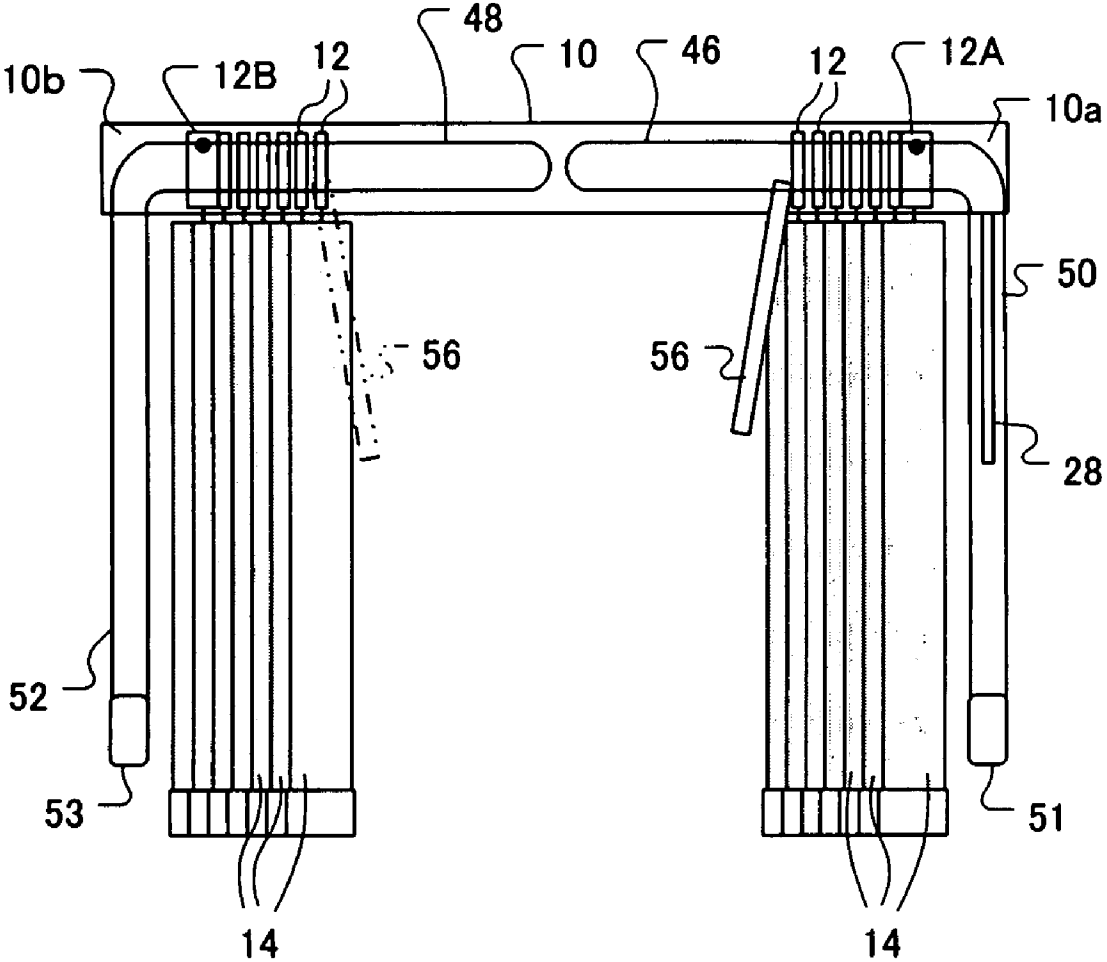
FIG. 18 illustrates the vertical blind according to the third embodiment in a state in which the central part of the head rail is opened.

It is also possible to gather all the louvers 14 at the center as shown in FIG. 17 by manipulating both the first operating device 50 and the second operating device 52. With an operating rod, such as a baton 56, being provided as shown in FIG. 18, it is possible to fold the louvers 14 in a state of being separated to the two sides from this centrally gathered state by drawing the half of the carriers 12 closer to the first end 10*a* side toward the first end 10*a* and the other half closer to the second end 10*b* toward the second end 10*b*, so that the central part of the opening to which the vertical blind is installed can be fully uncovered, to enable the external view to be seen or the external atmosphere to be let in. The operating rod, such as the baton 56, can be either hung from the head rail 10 to be movable along the head rail 10 or detached from the head rail 10.

Fourth Embodiment

Figure 19:
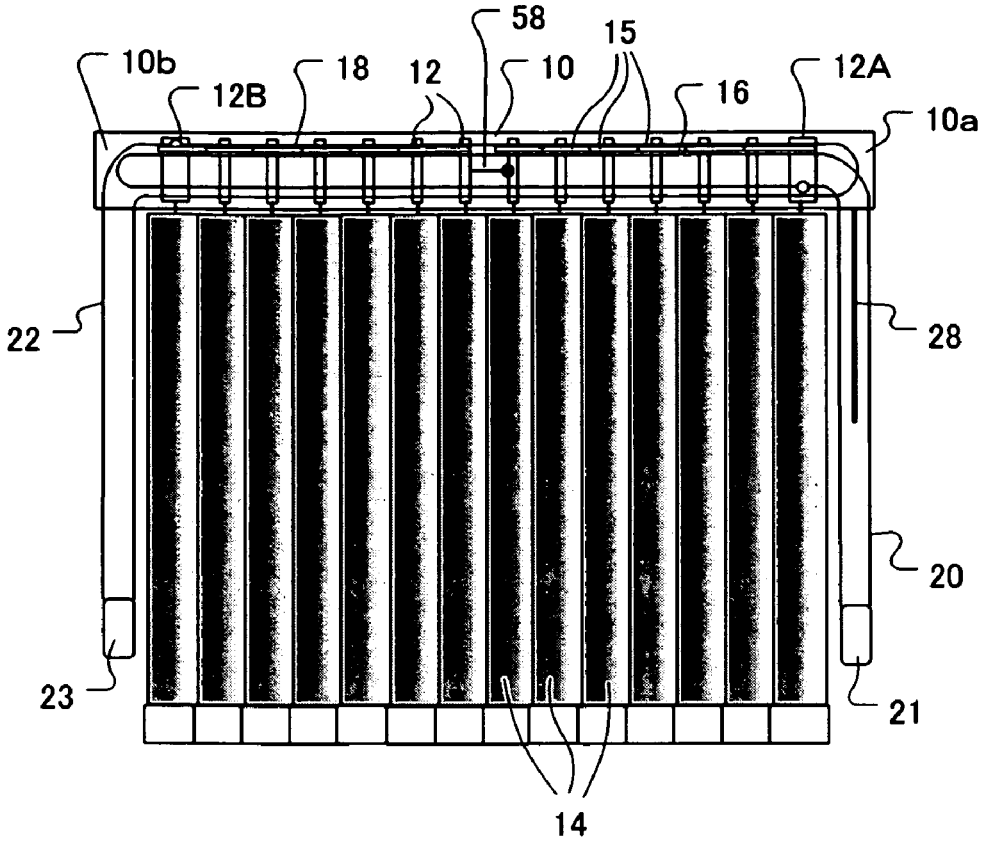
FIG. 19 illustrates a vertical blind according to a fourth embodiment of the invention, in a state in which the louvers are extended over the whole length of the head rail.

Next, FIG. 19 illustrates a vertical blind according to a fourth embodiment of the present invention, wherein the same constituent members as in the first embodiment are denoted by respectively the same reference signs, and their detailed description will be omitted.

In this embodiment, two central ones among the plurality of carriers 12 are connected by a separable link 58 which can completely separate the adjoining two central carriers 12, instead of a spacer link 15. In this respect this embodiment differs from, but in all other respects the same as, the first embodiment.

Figure 20:
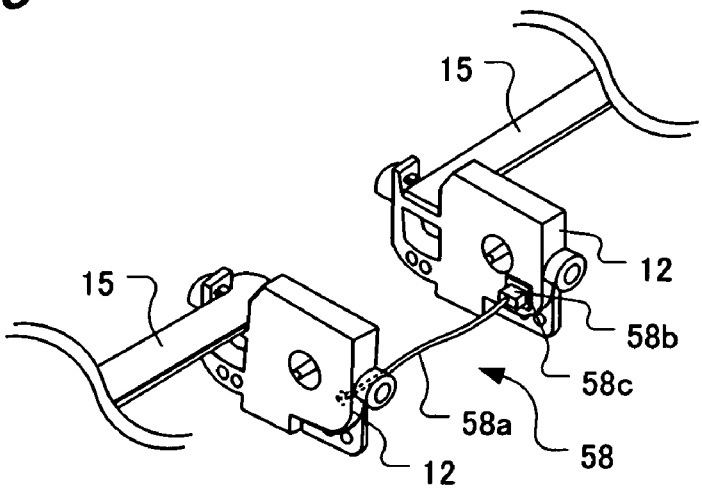
FIG. 20 illustrates a separable link.

This separable link 58 can be configured of, for instance as shown in FIG. 20, a cord 58*a*, of which one end is connected to one of the two central carriers 12 and a magnet or magnetic material 58*b* provided at the tip of the cord 58*a*, and the other one of the two central carriers 12 is provided with a magnetic material or magnet 58*c* which attracts and is attracted by the magnet or magnetic material 58*b* by a magnetic force.

Figure 21:
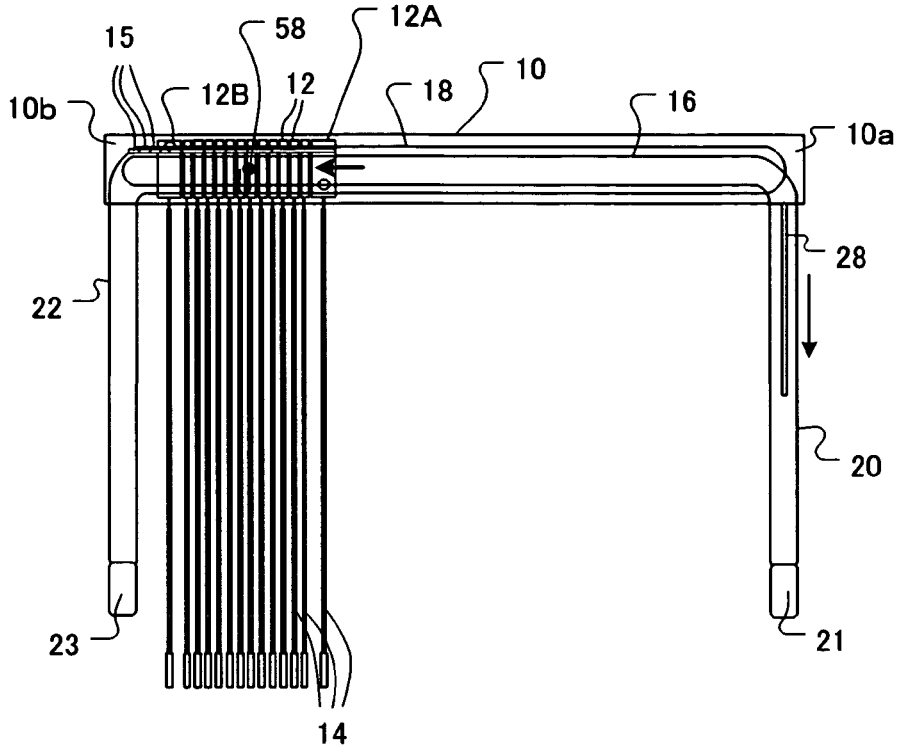
FIG. 21 illustrates the vertical blind according to the fourth embodiment in a state in which the louvers are folded at a second end of the head rail.
Figure 22:
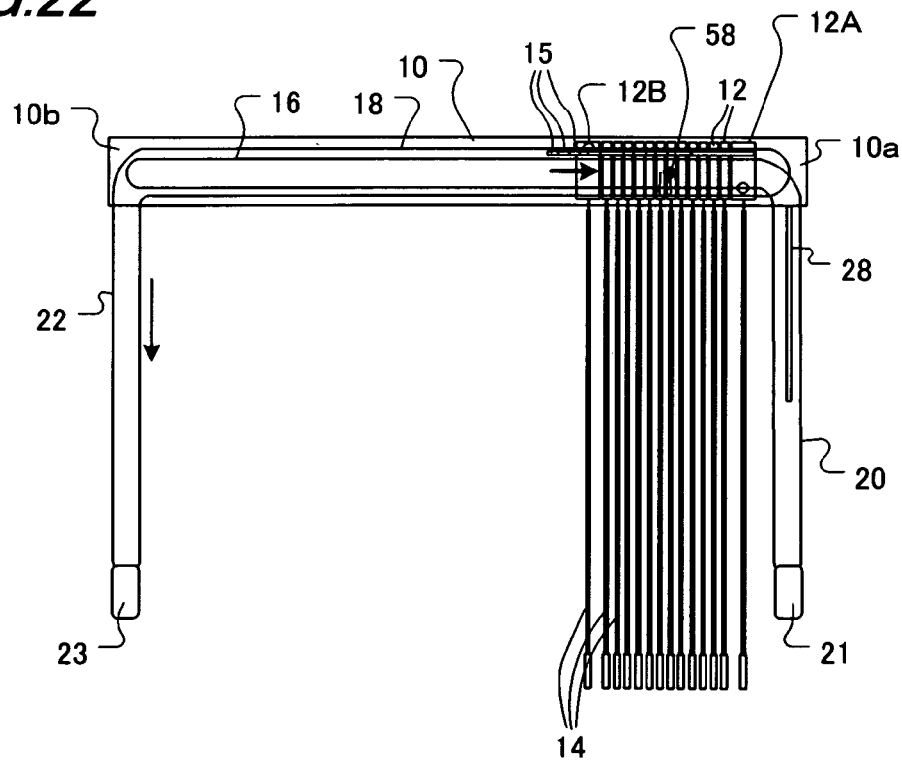
FIG. 22 illustrates the vertical blind according to the fourth embodiment in a state in which the louvers are folded at a first end of the head rail.
Figure 23:
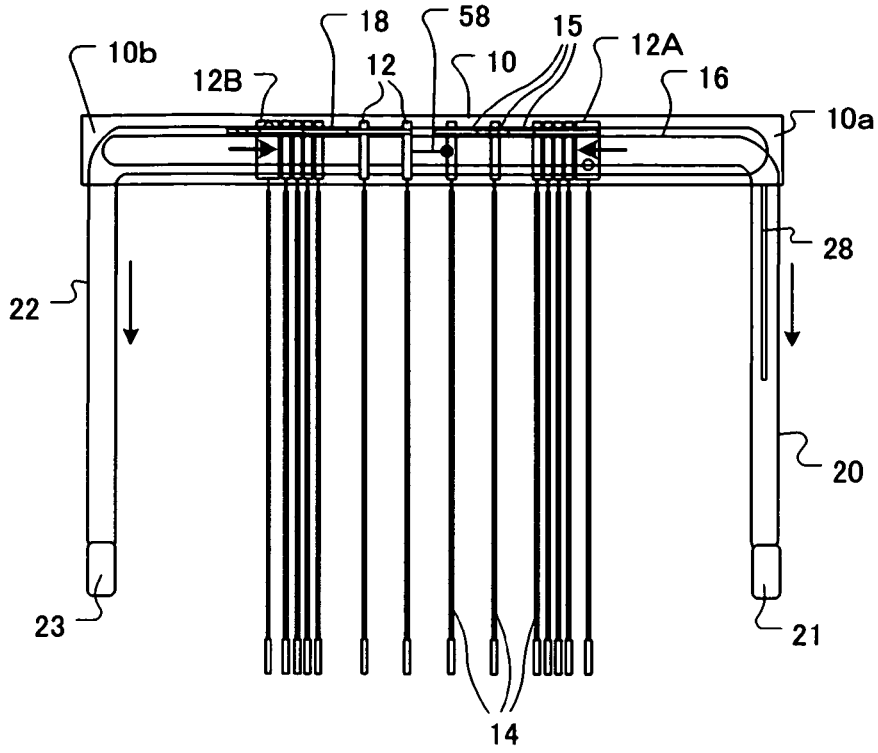
FIG. 23 illustrates the vertical blind according to the fourth embodiment in a state in which both ends of the head rail are opened.

The operations of the vertical blind configured as described are basically the same as those of the first embodiment. It can perform the operations illustrated in FIG. 3 through FIG. 9. For instance, when the first master carrier 12A is moved toward the second end 10*b* from the state shown in FIG. 9 by manipulating the first operating device 20, as the first master carrier 12A successively presses the other carriers 12 in the same direction, the louvers 14 are moved to be folded toward the second end 10*b* of the head rail 10 as shown in FIG. 21. The space underneath the first end 10*a* can be opened in this way. On the other hand, when the second master carrier 12B is moved toward the first end 10*a* by manipulating the second the operating device 22, as the second master carrier 12B successively presses the other carriers 12 in the same direction, the louvers 14 are moved to be folded toward the first end 10*a* of the head rail 10 as shown in FIG. 22. The space underneath the second end 10*b* can be opened in this way. Further, when the first operating device 20 and the second the operating device 22 are manipulated until midway, the louvers 14 can be gathered toward the central part of the head rail 10 as shown in FIG. 23. During the above-described operations from FIG. 21 through FIG. 23, or while the blind is returned from the state shown in FIG. 21 through FIG. 23 to that shown in FIG. 9, the two central carriers 12 are connected by the separable link 58, the maximum spacing between them being the length of the cord 58*a*, as is the case with a spacer link 15.

Figure 24:
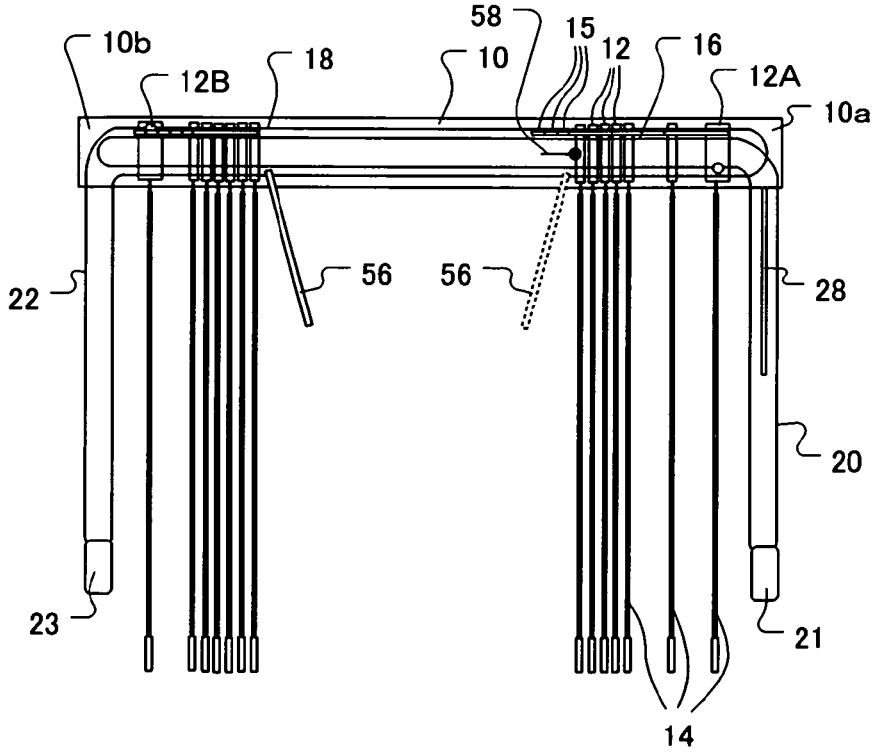
FIG. 24 illustrates the vertical blind according to the fourth embodiment in a state in which the central part of the head rail is opened.

On the other hand, it is possible to separate, from the state shown in FIG. 9, the separable link 58 by using an operating rod, such as the baton 56, to forcibly separate the two central carriers 12 and 12, and thereby draw a half of the carriers 12 closer to the first end 10*a* toward the first end 10*a* and the other half of the carriers 12 closer to the second end 10*b* toward the second end 10*b*, resulting in the folding of the louvers 14 separated to the two sides as shown in FIG. 24. When the blind is returned to its state shown in FIG. 9, the separable link 58 connects the two carriers 12 and 12 by a magnetic force.

In this way the vertical blind according to this fourth embodiment of the invention, can be operated in any of the patterns including the folding toward the first end 10*a* (the space underneath the second end 10*b* being opened), that toward the second end 10*b* (the space underneath the first end 10*a* being opened) and the central folding (the space underneath both sides being opened).

Fifth Embodiment

Any of the embodiments described above uses a cord to move the master carriers, however, a screw rod arranged in the head rail 10 may be threadably engaged to the master carriers, so that each master carrier can be moved by turning the screw rod.

Figure 25:
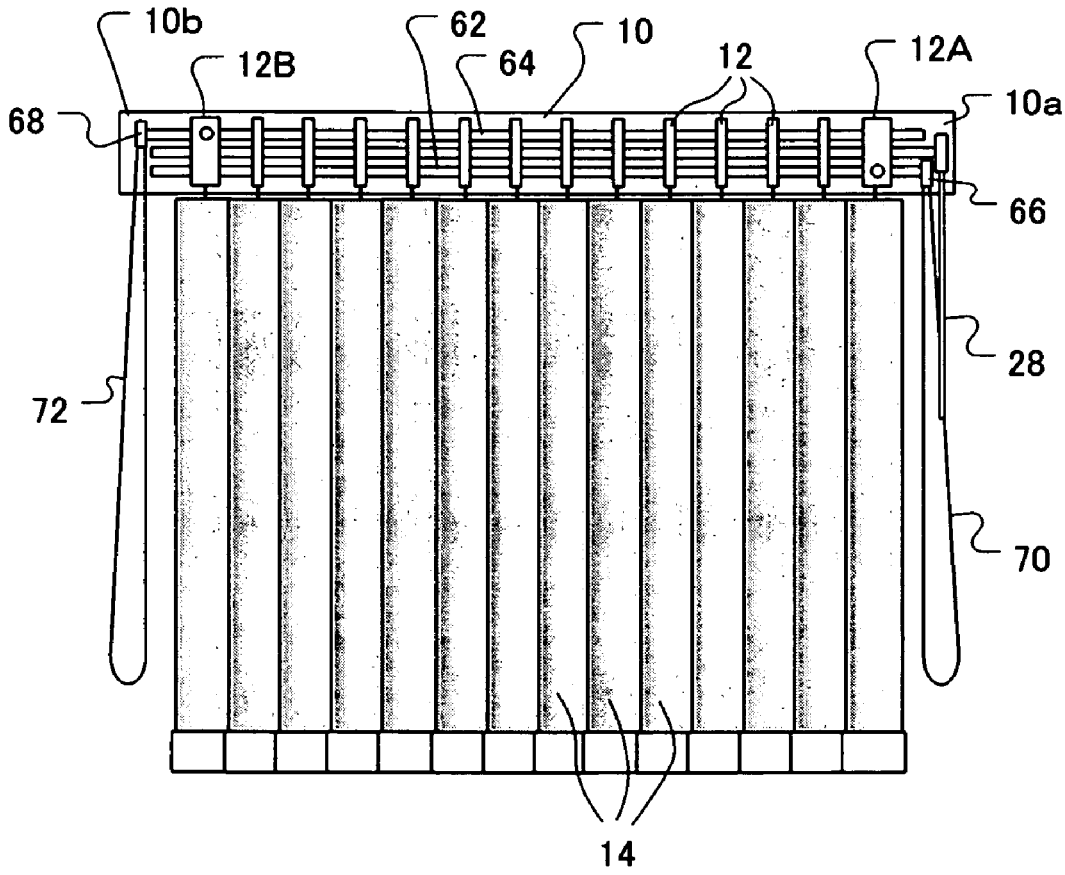
FIG. 25 illustrates a vertical blind according to a fifth embodiment of the invention, in a state in which the louvers are extended over the whole length of the head rail.
Figure 26:
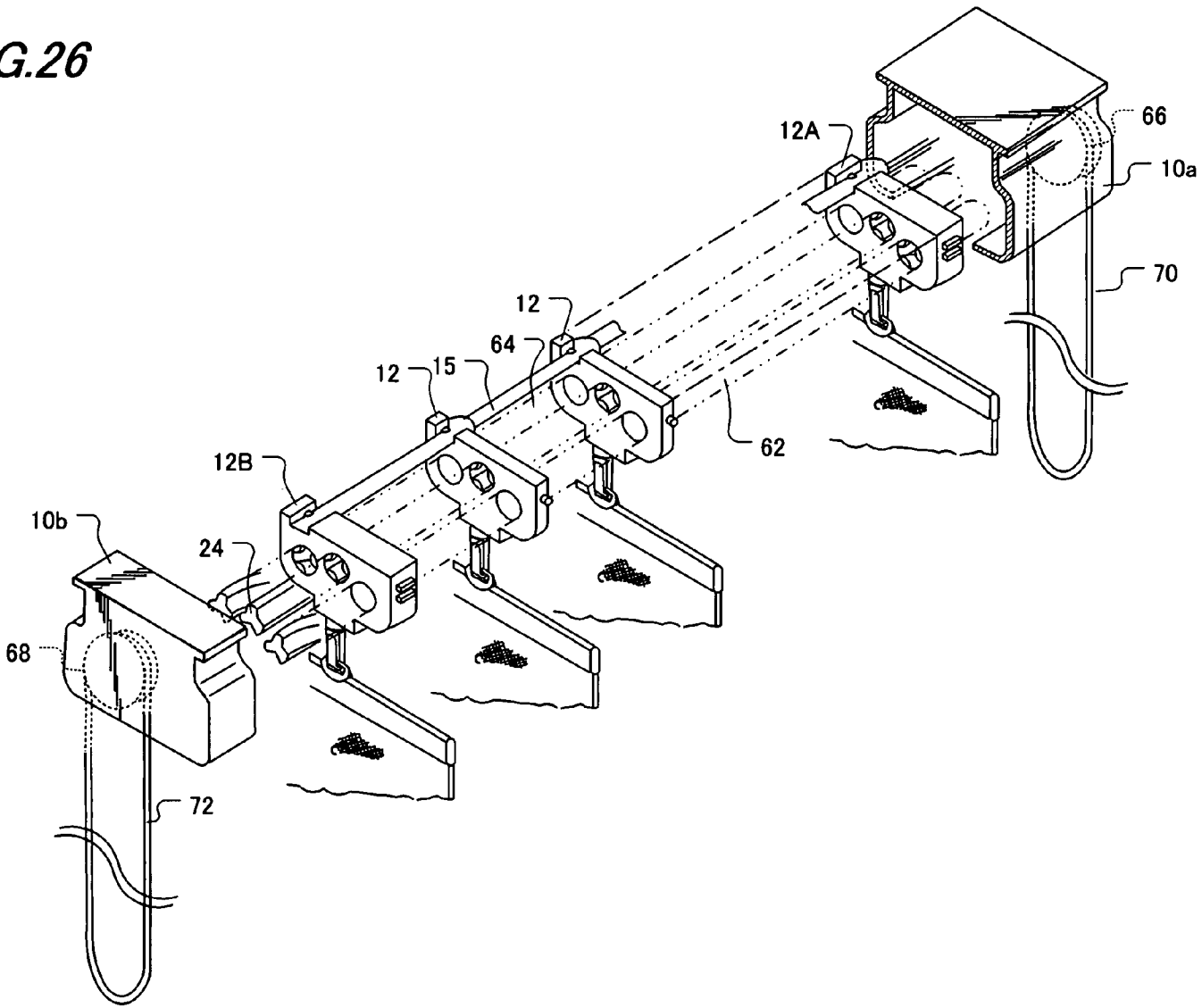
FIG. 26 shows a perspective view of the inside of the head rail of the vertical blind shown in FIG. 25.

FIG. 25 and FIG. 26 illustrate a fifth embodiment of the present invention using screw rods. A first screw rod 62 and a second screw rod 64 extend within the head rail 10 in the lengthwise direction in parallel with the tilting rod 24, and the first screw rod 62 and the second screw rod 64 are rotatably supported within the head rail 10. The first screw rod 62 is connected to a pulley 66 at the first end 10*a*. An endless operating cord 70 wound round the pulley 66 is hung from the head rail 10 to constitute a first operating device. Similarly, the second screw rod 64 is connected to a pulley 68 at the second end 10*b*. An endless operating cord 72 wound round the pulley 68 is hung from the head rail 10 to constitute a second operating device.

The first master carrier 12A is threadably mounted on the first screw rod 62, while the second master carrier 12B is threadably mounted on the second screw rod 64. The first master carrier 12A is not threadably engaged to the second screw rod 64, and the second master carrier 12B is not threadably engaged to the first screw rod 62.

Figure 27:
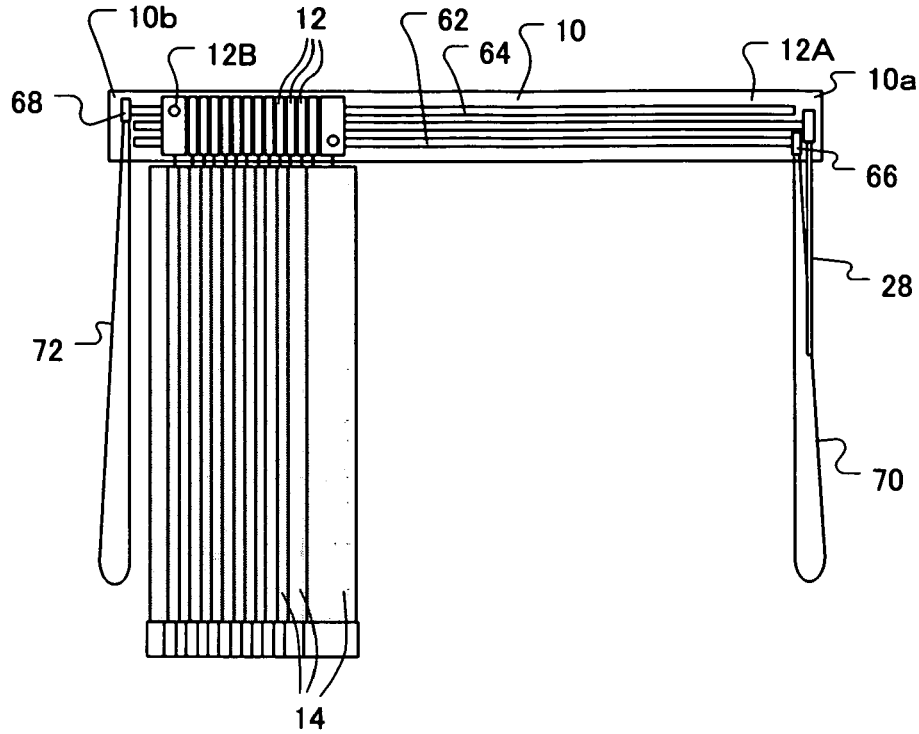
FIG. 27 illustrates the vertical blind according to the fifth embodiment in a state in which the louvers are folded at a second end of the head rail.

In the vertical blind configured as described above, when the endless operating cord 70 is manipulated to turn the pulley 66 in a prescribed direction, the rotation is transmitted to the first screw rod 62 which integrally rotates with the pulley 66 to move the first master carrier 12A screwed on to the first screw rod 62 toward the second end 10*b* of the head rail 10. Other carriers 12 are successively pressed out in the same direction to achieve a state in which the louvers are folded toward the second end 10*b* of the head rail 10 as shown in FIG. 27. In this way, the space underneath the first end 10*a* can be opened. When the pulley 66 is turned in the direction reverse to the above-mentioned by manipulating the endless operating cord 70, the rotation in the direction reverse to the above-mentioned is transmitted to the first screw rod 62 to move the first master carrier 12A toward the first end 10*a* of the head rail 10. Other successively adjoining carriers 12 linked by the spacer links 15 are pulled by the first master carrier 12A to move in the same direction to the state shown in FIG. 25.

Figure 28:
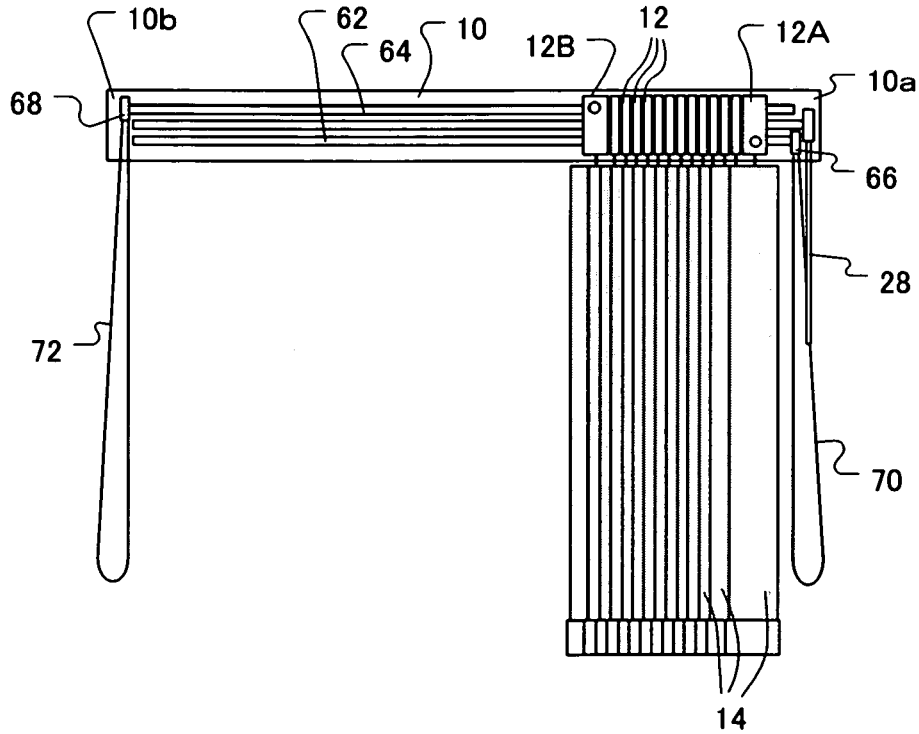
FIG. 28 illustrates the vertical blind according to the fifth embodiment in a state in which the louvers are folded at a first end of the head rail.

Similarly when the pulley 68 is turned in a prescribed direction by manipulating the endless operating cord 72, the rotation is transmitted to the second screw rod 64 which integrally rotates with the pulley 68 to move the second master carrier 12B screwed on to the second screw rod 64 toward the first end 10*a* of the head rail 10. Other carriers 12 are successively pressed out in the same direction to achieve a state in which the louvers are folded toward the first end 10*a* of the head rail 10 as shown in FIG. 28. In this way the space underneath the second end 10*b* can be opened. When the pulley 68 is turned in the direction reverse to the above-mentioned by manipulating the endless operating cord 72, the rotation in the direction reverse to the above-mentioned is transmitted to the second screw rod 64 to move the second master carrier 12B toward the second end 10*b* of the head rail 10. Other successively adjoining carriers 12 linked by the spacer links 15 are pulled by the second master carrier 12B to move in the same direction to the state shown in FIG. 25.

Thus, the blind using screw rods can operate in the same way as the foregoing embodiments of the invention.

Although the fifth embodiment has been described with reference to an example in which the cords 16 and 18 of the first embodiment are replaced with the screw rods 62 and 64, it is of course also possible to replace the cords 36, 38, 46 and 48 in the second to fourth embodiments with screw rods. For the second embodiment, a single screw rod whose screw direction is reversed beyond the center may be used. Also, though two screw rods are used in this illustrated example, it is obviously possible to use a screw rod or rods and a cord or cords in combination, wherein at least one of the master carriers may be threadably mounted on a screw rod while the rest of the master carriers are connected to cords. For instance, only one of the cords 16 and 18 in the first or fourth embodiment can be replaced with a screw rod, only one of the cords 36 and 38 in the second embodiment can be replaced with a screw rod, or only one of the cords 46 and 48 in the third embodiment may be replaced with a screw rod.

Sixth Embodiment

As described above, adjoining carriers 12 are connected at a maximum spacing which is equal to a prescribed spacing determined by a length of a spacer link 15. More specifically, the spacer links 15 are made of a relatively rigid material. One end of each spacer link 15 is fixed to a corresponding carrier 12, while the other end extends beyond that carrier 12 to the adjoining carrier 12 to be slidably connectable to the adjoining carrier 12. At the other end of the spacer link 15 is formed a stopper 15*a* to prevent the spacer link 15 from coming off the adjoining carriers 12.

In a state in which the louvers 14 are folded at one end and the carriers 12 are close to each other, the spacing between each pair of adjoining carriers 12 is smaller than the maximum spacing and, since the spacer links 15 are rigid, the other end of each spacer link 15 extends beyond one of the adjoining carriers 12. In the first through fifth embodiments described so far, since it is possible to fold the louvers 14 at either the first end 10*a* or the second end 10*b* of the head rail 10, when the louvers 14 are folded at the end of the head rail 10 toward the other ends of the spacer links 15, the other ends of the spacer links 15 may hit the end of the head rail 10 and/or any nearby component and break them.

Figure 29:
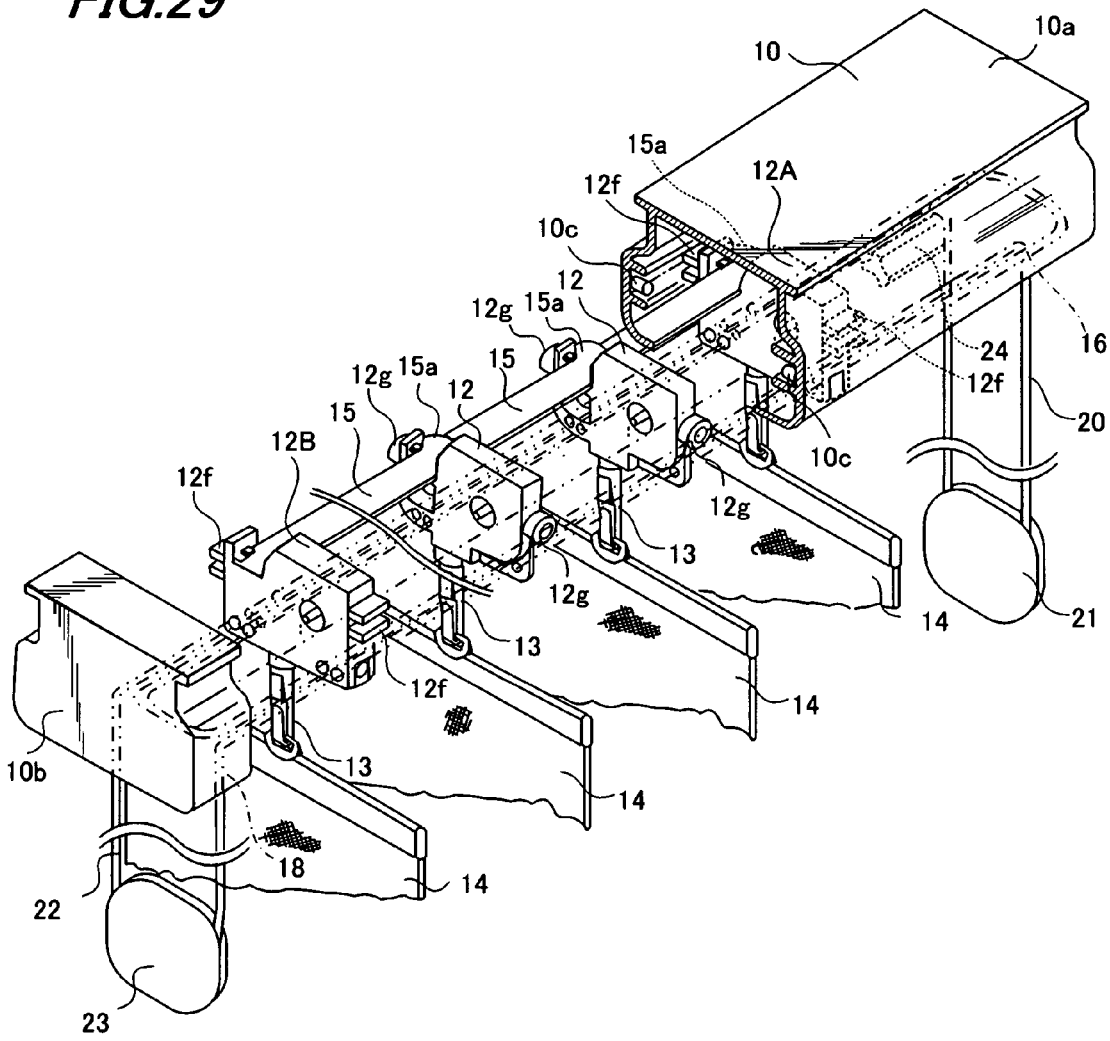
FIG. 29 shows a perspective view of the inside of a head rail of a vertical blind according to a sixth embodiment of the invention.
Figure 30A:
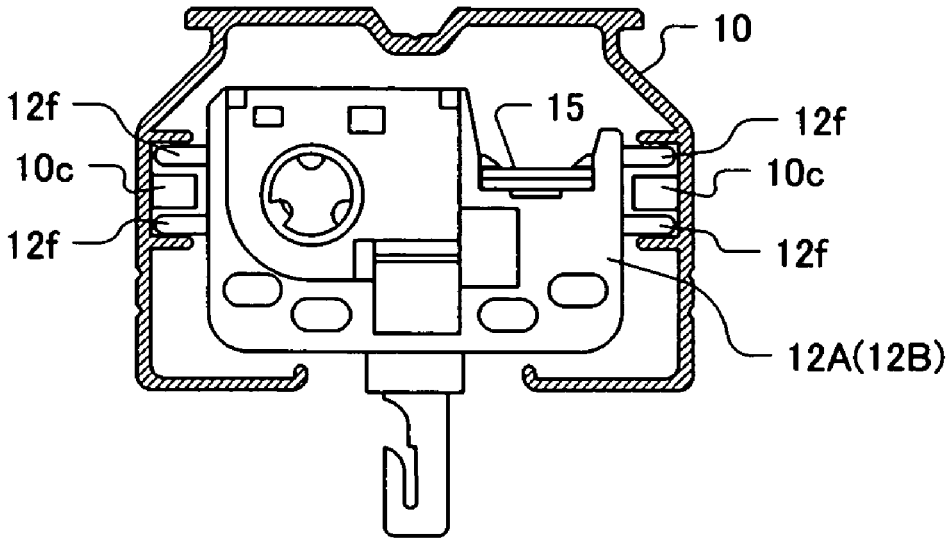
FIG. 30A shows a master carrier in a head rail, and FIG. 30B, other carriers than the master carrier.
Figure 30B:
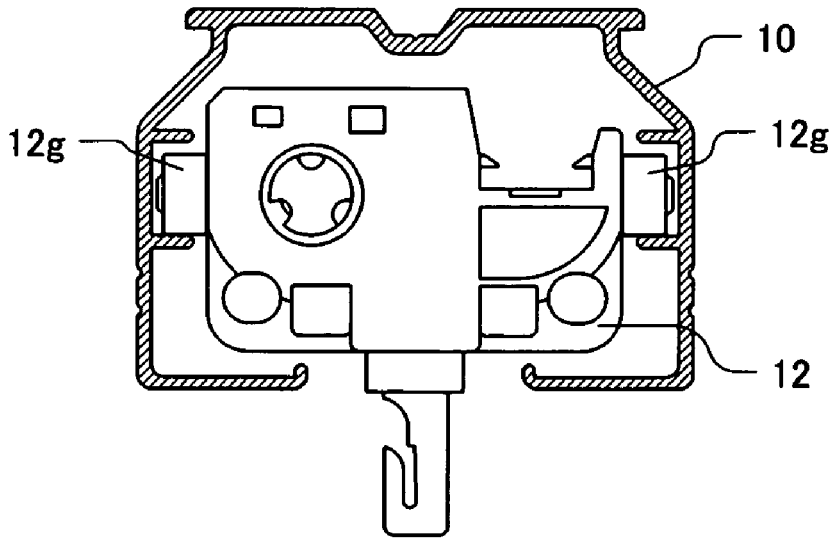
Figure 32:
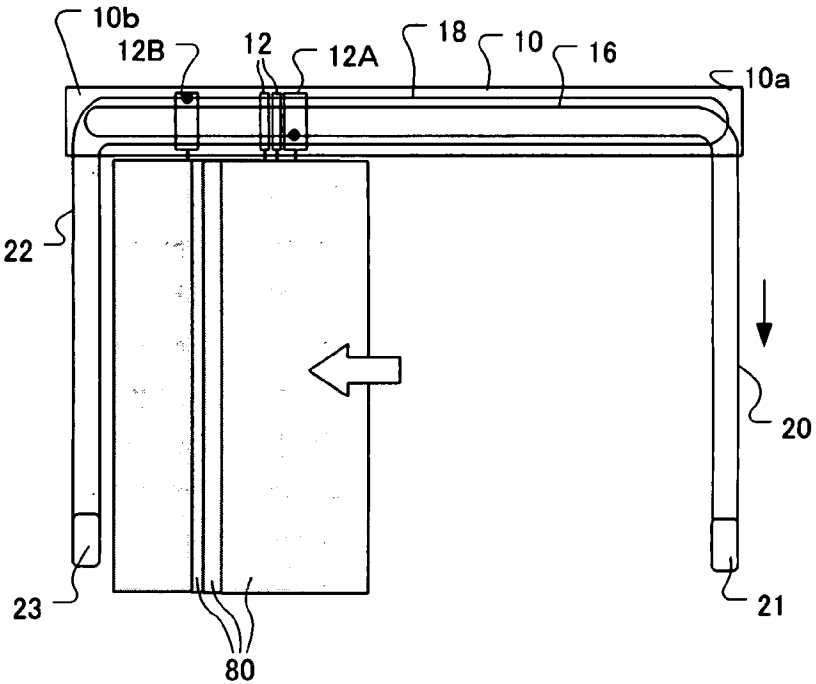
FIG. 32 illustrates the seventh embodiment in a state in which the first end of the head rail is opened.

In the sixth embodiment of the invention, this risk of breakage is eliminated. Supposing that the other end side of the spacer links 15 is toward the first end 10*a* of the head rail 10 now as shown in FIG. 29, stopper pins 10*c* are provided beside the first end 10*a* of the head rail 10 or the vicinities thereof, and projections (sliders) 12*f* that can pass the stopper pins 10*c* are provided on both sides of the master carrier 12A (12B), while projections (rollers) 12*g* that cannot pass the stopper pins 10*c* are provided on both sides of other carriers 12 except the master carrier 12A (12B). By virtue of this arrangement, when the carriers 12 approaches the end of the head rail 10 and the louvers 14 are folded, though the master carrier 12A passes the stopper pins 10*c* and move toward the first end 10*a* as far as it can go, the next carrier 12 is prevented by the stopper pins 10*c* from passing and stops in a position a little away from the master carrier 12A. Each of the following carriers 12 successively approaches the carrier 12 immediately before and stops. The spacer links 15 are not fixed to the master carrier 12A, and the other end of each of the spacer links 15 of which one end is fixed to the next carrier 12 extends toward the master carrier 12A, but it is not broken by hitting against the first end 10*a* or any component in the first end 10*a* because its distance to the first end 10*a* is regulated by the stopper pins 10*c*.

This sixth embodiment can be applied to any of the embodiments above-described.

Seventh Embodiment

Figure 31:
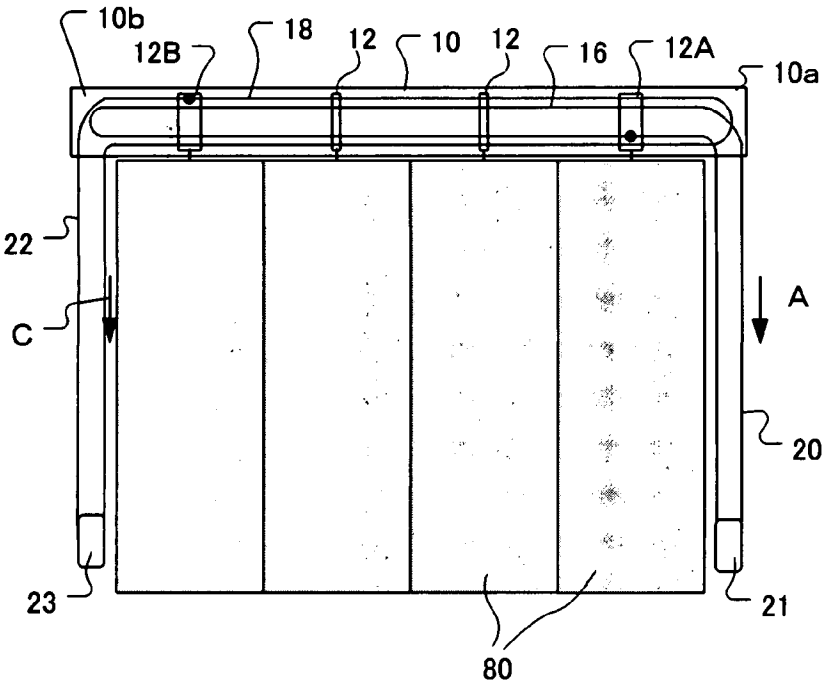
FIG. 31 illustrates the vertical blind according to a seventh embodiment of the invention in a state in which the louvers are extended over the whole length of the head rail.
Figure 33:
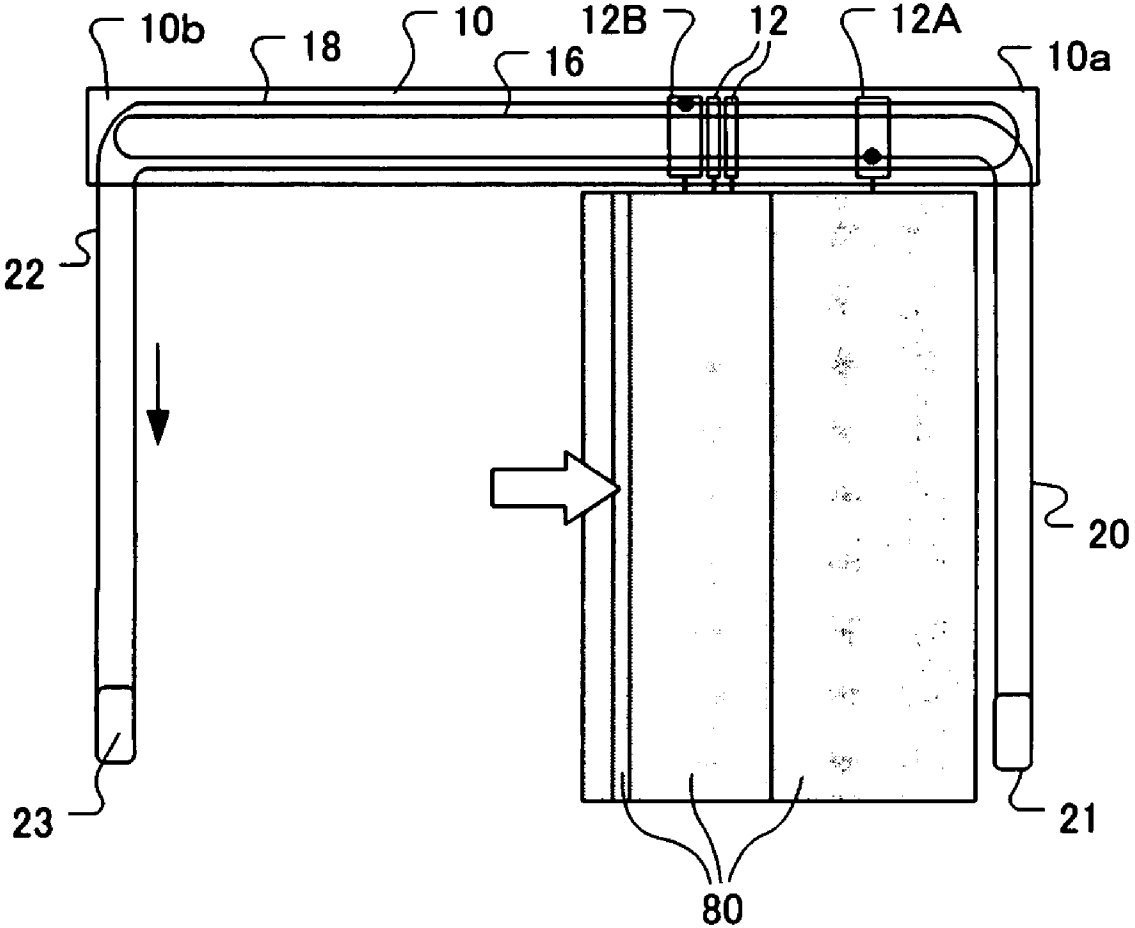
FIG. 33 illustrates the seventh embodiment in a state in which the second end of the head rail is opened.

FIG. 31 illustrates a blind according to a seventh embodiment of the present invention, wherein the same constituent members as in the foregoing embodiments are denoted by respectively the same reference signs, and their detailed description will be omitted.

In this seventh embodiment, the present invention is applied to an example of the panel blind in which a louver is comprised of a panel.

In conventional vertical blind, the louver is comprised of a strip, however in this embodiment, the louver is a screen 80 which is a panel type made of either soft material or rigid material and its width is wider than that of the conventional louver used in the vertical blind. The other components are constructed in a similar way to the first embodiment.

In such a panel blind, when the first cord 16 is pulled in the direction of A in FIG. 31 by manipulating the first operating device 20, the screens 80 move toward the second end 10*b* of the head rail 10. At the same time, the space underneath the first end 10*a* is opened so that the part of the window at the first end 10*a* can be opened or closed, persons can go out or come in through that opening, the window can be cleaned, or ventilation can be achieved.

On the other hand, when the second cord 18 is pulled in the direction of C in FIG. 31 by manipulating the second operating device 22, the screens 80 move toward the first end 10*a* of the head rail 10. At the same time, the space underneath the second end 10*b* is opened so that the part of the window at the second end 10*ba* can be opened or closed, persons can go out or come in through that opening, the window can be cleaned, or ventilation can be achieved.

In this way, similar operations to the first embodiment can be achieved.

Other Aspects

In any of the foregoing embodiments, where operating rods 28 as the third operating device and the fourth operating device are provided at both the first end 10*a* and the second end 10*b*, it is possible to make the louvers 14 turnable from either end of the head rail 10.

As hitherto described, as the present invention makes it possible to move louvers by manipulating an operating device to open either or both of the two ends of the head rail, the part of the window at the opened end can be opened or closed, persons can be let go out or come in through that opening, the window can be cleaned, or ventilation can be achieved as desired. Since the louvers can be moved without having to hold any of them directly by hand, the louvers can be prevented from being smeared or twisted.

While the principles of the invention have been described above in connection with specific embodiments, and particular modifications thereof, it is to be clearly understood that this description is made only by way of example and not as a limitation on the scope of invention.

What is claimed is:

1. A blind comprising:

a head rail;

a plurality of carriers that can run within the head rail;

a louver hung from each of the carriers;

a first operating device for moving the plurality of carriers along the head rail; and a second operating device for moving the plurality of carriers along the head rail, wherein the louvers are moved along the head rail in a determined direction to open a space under a first end of the head rail by manipulating the first operating device, and the louvers are moved along the head rail in a direction opposite to the determined direction to open a space under a second end of the head rail by manipulating the second operating device; and a plurality of spacer links, one end of each link is fixed to a respective carrier except the carrier closest to the first end of the head rail, and the other end of each link is slidably connected to the adjoining carrier on the first end's side of the carrier for connecting said carrier to the adjoining carriers at the maximum spacing which is equal to the prescribed spacing; and a stopper which permits the passage of the carrier closest to the first end of the head rail but prohibits the passage of the next carrier, is provided in the vicinity of the first end of said head rail.

2. The blind according to claim 1, further comprising a third operating device on the first end of the head rail and a fourth operating device on the second end of the head rail, wherein the louvers are turned by manipulating the third operating device or the fourth operating device.

3. A blind comprising:

a head rail;

a plurality of carriers that can run within the head rail;

a louver hung from each of the carriers;

a first operating device positioned fixedly in a longitudinal direction of the head rail; and a second operating device positioned fixedly in a longitudinal direction of the head rail, wherein the louvers can be moved to open a space under a first end of the head rail by manipulating the first operating device, and the louvers can be moved to open a space under a second end of the head rail by manipulating the second operating device, wherein the carrier arranged closest to the first end of the head rail constitutes a first master carrier and the carrier arranged closest to the second end of the head rail constitutes a second master carrier, wherein manipulation of the first operating device causes the first master carrier to move toward the second end of the head rail thereby to open the space underneath the first end and manipulation of the second operating device causes the second master carrier to move toward the first end of the head rail thereby to open the space underneath the second end, wherein, within the head rail, an endless first cord connected to the first master carrier is arranged around to move the first master carrier by manipulating the first operating device and an endless second cord connected to the second master carrier is arranged to move the second master carrier by manipulating the second operating device.

4. The blind according to claim 3, wherein either one of said endless first cord and said endless second cord is arranged on a front side of the head rail and the other is arranged on a rear side of the head rail.

5. The blind according to claim 3, wherein either one of said endless first cord and said endless second cord is arranged inside of the other of said endless first cord and said endless second cord.

6. A blind comprising:

a head rail;

a plurality of carriers that can run within the head rail;

a louver hung from each of the carriers;

a first operating device positioned fixedly in a longitudinal direction of the head rail for moving the plurality of carriers along the head rail; and a second operating device positioned fixedly in a longitudinal direction of the head rail for moving the plurality of carriers along the head rail, wherein the louvers can be moved along the head rail in a determined direction to open a space under a first end of the head rail by manipulating the first operating device, and the louvers can be moved along the head rail in a direction opposite to the determined direction to open a space under a second end of the head rail by manipulating the second operating device, wherein, among said carriers, the carrier arranged closest to the first end of the head rail constitutes a first master carrier and the carrier arranged closest to the second end of the head rail constitutes a second master carrier, wherein manipulation of the first operating device causes the first master carrier to move toward the second end of the head rail thereby to open the space underneath the first end and manipulation of the second operating device causes the second master carrier to move toward the first end of the head rail thereby to open the space underneath the second end, and wherein, within the head rail, an endless first cord connected to the first master carrier is arranged to move the first master carrier by manipulating the first operating device and an endless second cord connected to the second master carrier is arranged to move the second master carrier by manipulating the second operating device.

7. A blind comprising:

a head rail;

a plurality of carriers that can run within the head rail;

a louver hung from each of the carriers;

a first operating device positioned fixedly in a longitudinal direction of the head rail; and a second operating device positioned fixedly in a longitudinal direction of the head rail, wherein, among said carrier, the carrier arranged closest to the first end of the head rail constitutes a first master carrier and the carrier arranged closest to the second end of the head rail constitutes a second master carrier, wherein manipulation of the first operating device causes the first master carrier to move toward the second end of the head rail thereby to open the space underneath the first end and manipulation of the second operating device causes the second master carrier to move toward the first end of the head rail thereby to open the space underneath the second end.

8. The blind of claim 7, wherein within the head rail, an endless first cord connected to the first master carrier is arranged to move the first master carrier by manipulating the first operating device and an endless second cord connected to the second master carrier is arranged to move the second master carrier by manipulating the second operating device.

9. The blind of claim 8, wherein either one of said endless first cord and said endless second cord is arranged on a front side of the head rail and the other is arranged on a rear side of the head rail.

10. The blind of claim 8, wherein either one of said endless first cord and said endless second cord is arranged inside of the other of said endless first cord and said endless second cord.

11. A blind comprising:

a head rail;

a plurality of carriers that can run within the head rail;

a louver hung from each of the carriers;

a first operating device for moving the plurality of carriers along the head rail, said first operating device positioned fixedly in a longitudinal direction of the head rail;

a second operating device for moving the plurality of carriers along the head rail, said second operating device positioned fixedly in a longitudinal direction of the head rail, wherein the louvers are moved along the head rail in a determined direction so as to open a space under a first end of the head rail by manipulating the first operating device, and the louvers are moved along the head rail in a direction opposite to the determined direction so as to open a space under a second end of the head rail by manipulating the second operating device;

a plurality of spacer links, one end of each is fixed to a respective carrier except the carrier closest to the first end of the head rail, and the other end of each link is slidably connected to the adjoining carrier on the first end's side of the carrier for connecting said carrier to the adjoining carrier at the maximum spacing which is equal to the prescribed spacing; and a stopper which permits the passage of the carrier closest to the first end of the head rail but prohibits the passage of the next carrier, provided in the vicinity of the first end of said head rail.

12. The blind of claim 11, further comprising a third operating device on the first end of the head rail and a fourth operating device on the second end of the head rail, wherein the louvers are turned by manipulating the third operating device or the fourth operating device.

* * * * *

UNITED STATES PATENT AND TRADEMARK OFFICE

CERTIFICATE OF CORRECTION

PATENT NO. : 7,377,302 B2
APPLICATION NO. : 10/761741
DATED : May 27, 2008
INVENTOR(S) : Nakamura et al.

It is certified that error appears in the above-identified patent and that said Letters Patent is hereby corrected as shown below:

On the Title page item (56), under Other Publications:

Please delete "Office Action, Application No. 2004-005887, dated Oct. 3, 2008." and insert --Office Action, Application No. 2004-005887, dated Oct. 3, 2006.-- therefor;

In the Claims:

Column 16, Claim 3, Line 58, please delete "around";

Column 18, Claim 11, Line 37, please insert --link-- after each.

Signed and Sealed this

Second Day of June, 2009

JOHN DOLL
*Acting Director of the United States Patent and Trademark Office*